US009207554B2

(12) United States Patent
Murayama

(10) Patent No.: US 9,207,554 B2
(45) Date of Patent: Dec. 8, 2015

(54) IMAGE FORMING APPARATUS HAVING IMPROVED IMAGE QUALITY

(71) Applicant: Kentaro Murayama, Kasugai (JP)

(72) Inventor: Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 135 days.

(21) Appl. No.: 14/036,085

(22) Filed: Sep. 25, 2013

(65) Prior Publication Data

US 2014/0186076 A1 Jul. 3, 2014

(30) Foreign Application Priority Data

Dec. 28, 2012 (JP) ..... 2012-288686

(51) Int. Cl.
*G03G 15/01* (2006.01)
*G03G 15/00* (2006.01)

(52) U.S. Cl.
CPC ..... *G03G 15/0189* (2013.01); *G03G 15/5058* (2013.01)

(58) Field of Classification Search
None
See application file for complete search history.

(56) References Cited

U.S. PATENT DOCUMENTS

| | | | | |
|---|---|---|---|---|
| 5,627,649 | A | 5/1997 | Sawayama et al. | |
| 6,408,156 | B1 * | 6/2002 | Miyazaki et al. | 399/301 |
| 6,930,786 | B2 * | 8/2005 | Kataoka et al. | 358/1.12 |
| 2003/0210412 | A1 | 11/2003 | Ishibashi | |
| 2008/0030787 | A1 * | 2/2008 | McElvain | 358/3.26 |
| 2008/0292370 | A1 * | 11/2008 | Murayama | 399/301 |
| 2009/0162112 | A1 * | 6/2009 | Murayama | 399/301 |
| 2009/0238586 | A1 * | 9/2009 | Nishikawa et al. | 399/40 |
| 2010/0074638 | A1 * | 3/2010 | Murayama | 399/31 |
| 2010/0221025 | A1 * | 9/2010 | Takahashi | 399/49 |
| 2011/0026982 | A1 * | 2/2011 | Murayama | 399/301 |
| 2012/0008993 | A1 | 1/2012 | Maeda | |
| 2012/0163844 | A1 * | 6/2012 | Murayama et al. | 399/49 |

FOREIGN PATENT DOCUMENTS

| | | | |
|---|---|---|---|
| JP | H061002 | A | 1/1994 |
| JP | 2002-236405 | A | 8/2002 |
| JP | 2003-098793 | A | 4/2003 |
| JP | 2003-280317 | A | 10/2003 |
| JP | 2007-155895 | A | 6/2007 |
| JP | 2007292789 | A * | 11/2007 |
| JP | 2012-018279 | A | 1/2012 |

* cited by examiner

*Primary Examiner* — David Gray
*Assistant Examiner* — Geoffrey Evans
(74) *Attorney, Agent, or Firm* — Banner & Witcoff, Ltd.

(57) ABSTRACT

An image forming apparatus includes an image forming device which forms an image on a rotation member, a sensor, and a controller. The controller executes an overlapping pattern detection processing which detects a positional deviation amount using an overlapping pattern including a plurality of overlapping marks with overlapped colorant images of two colors, a non-overlapping pattern detection processing which detects a positional deviation amount using a non-overlapping pattern including a plurality of marks, each having a single color, and an execution processing which executes the overlapping pattern detection processing or the non-overlapping pattern detection processing based on a condition.

16 Claims, 14 Drawing Sheets

IMAGE FORMING APPARATUS HAVING IMPROVED IMAGE QUALITY

CROSS-REFERENCE TO RELATED APPLICATION

This application claims priority from Japanese Patent Application No. 2012-288686, filed on Dec. 28, 2012, the entire subject matter of which is incorporated herein by reference.

TECHNICAL FIELD

Aspects of the present invention relate to an image forming apparatus.

BACKGROUND

For example, JP-A-2003-98793 discloses an image forming apparatus, in which non-overlapping patterns, which do not include a part having a plurality of colors overlapped therein, are formed on both ends of a transfer belt in a belt width direction, optical sensors for reading the non-overlapping patterns are provided at both ends of the transfer belt in the belt width direction, and an adjustment processing of performing a color matching is executed based on reading results of the optical sensors.

Also, for example, JP-A-H06-1002 discloses an image forming apparatus, in which a transfer belt is formed with an overlapping pattern including a part having a plurality of colors overlapped therein, and an adjustment processing of performing a color matching is executed based on a reading result of an optical sensor for the overlapping pattern.

SUMMARY

However, a close consideration of distinguishingly using an overlapping pattern and a non-overlapping pattern has not been made. Accordingly, an aspect of the present invention provides a technique capable of distinguishingly using an overlapping pattern and a non-overlapping pattern.

According to an illustrative embodiment of the present invention, there is provided an image forming apparatus including an image forming device configured to form an image on a rotation member using colorant, a sensor, and a controller. The controller is configured to execute an overlapping pattern detection processing, a non-overlapping pattern detection processing, and an execution processing. The overlapping pattern detection processing includes controlling the image forming device to form an overlapping pattern in an area detectable by the sensor, wherein the overlapping pattern includes a plurality of overlapping marks arranged in a rotating direction of the rotation member, each of the overlapping marks includes a colorant image of a first color and a colorant image of a second color overlapped on the colorant image of the first color, and an overlapping degree of the colorant image of the first color and the colorant image of the second color is different between the overlapping marks, and detecting a positional deviation amount between the colors. The non-overlapping pattern detection processing includes controlling the image forming device to form a non-overlapping pattern in the area detectable by the sensor, wherein the non-overlapping pattern includes a plurality of marks, each of which has a single color different from each other, and which are arranged so as not to overlap with each other in the rotating direction of the rotation member, and detecting a positional deviation amount between the marks. The execution processing includes executing the overlapping pattern detection processing when an overlapping pattern execution condition of executing the overlapping pattern detection processing is satisfied, and executing the non-overlapping pattern detection processing when a non-overlapping pattern execution condition of executing the non-overlapping pattern detection processing is satisfied.

The image forming apparatus determines whether to execute which one of the overlapping detection processing and the non-overlapping pattern detection processing, in accordance with the overlapping pattern execution condition and the non-overlapping pattern execution condition. Therefore, it is possible to distinguishingly use the overlapping pattern and the non-overlapping pattern by appropriately setting the execution conditions.

In the meantime, the technique disclosed in this specification can be implemented in a variety of modes such as an image forming method, an image forming system and the like.

According to the above image forming apparatus, it is possible to appropriately distinguishingly use the overlapping pattern and the non-overlapping pattern.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

First Illustrative Embodiment

Figure 1:
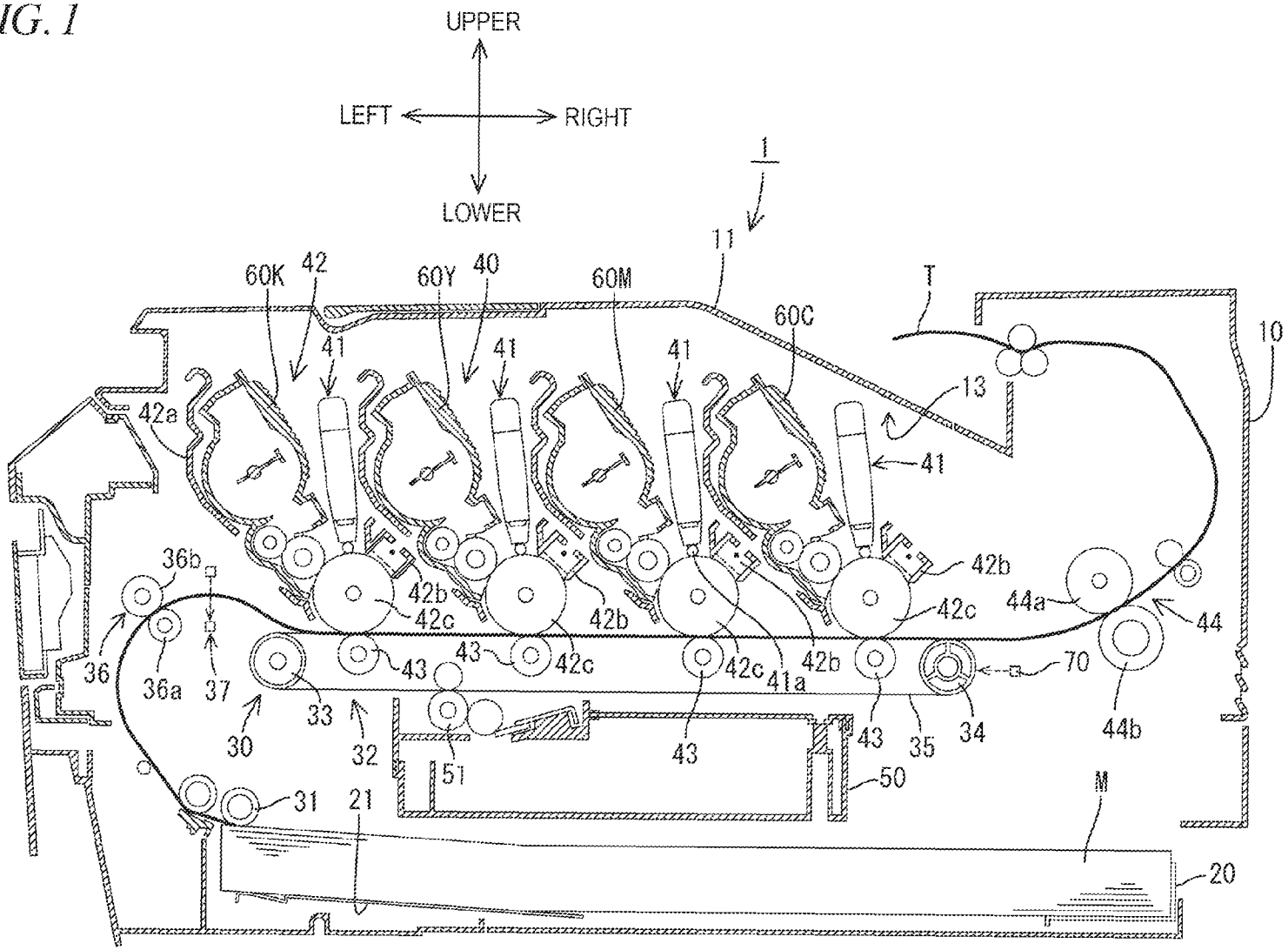
FIG. 1 is a sectional view showing a configuration of a printer according to a first illustrative embodiment.

A first illustrative embodiment is described with reference to FIGS. 1 to 13.

(1) Configuration of Printer

First, a configuration of a printer 1 which is an example of an image forming apparatus according to a first illustrative embodiment is described with reference to FIG. 1. The printer 1 is a direct transfer tandem-type color laser printer which prints a color image on a sheet M such as print sheet using four colors of cyan (C), magenta (M), yellow (Y) and black (K).

The printer 1 includes a body casing 10, a sheet accommodation unit 20, a conveyance unit 30, an image forming unit 40, a cleaning unit 50, an optical sensor 70 and the like.

The body casing 10 has a substantial box shape formed with an opening 13 which opens upwards and is connected with an opening/closing cover 11 which opens and closes the opening 13.

The sheet accommodation unit 20 includes a sheet tray 21 in which the sheet M is loaded. The sheet tray 21 is urged upwards by a spring (not shown), and the sheet M which is loaded at the uppermost of the sheet tray 21 is in pressure-contact with a pickup roller 31.

The conveyance unit 30 includes the pickup roller 31, a registration roller 36, a belt unit 32, a sensor 37 after the registration roller, and other conveyance rollers. The conveyance unit 30 conveys the sheets M, which are accommodated in the sheet accommodation unit 20, one by one along a conveyance path T.

The registration roller 36 includes a driving roller 36*a* and a driven roller 36*b*. The registration roller 36 is to correct a skew of the sheet M.

The belt unit 32 includes a driving roller 33, a driven roller 34, an endless conveyance belt 35 extending between the rollers 33, 34, a driving motor (not shown) for rotating the driving roller 33, and the like. The conveyance belt 35 is an example of a rotation member.

The conveyance belt 35 rotates in a clockwise direction in FIG. 1. The sheet M is conveyed from left to right by the conveyance belt 35. In the below descriptions, the conveying direction of the sheet M is referred to as a sub-scanning direction. Also, a vertical direction to the sheet of FIG. 1 is a main scanning direction which is orthogonal to the conveying direction.

The sensor 37 is arranged between the registration roller 36 and the conveyance belt 35. The sensor 37 is a sensor which outputs an on signal to a control unit 80 (refer to FIG. 2) (which will be described later) when the sheet M exists in a detection range and outputs an off signal when no sheet M exists in the detection range. The sensor 37 is used to determine a timing when the control unit 80 controls the image forming unit 40 to start image formation, and the like.

The image forming unit 40 (an example of an image forming device) includes a plurality of exposure units 41, a process cartridge 42, a plurality of transfer rollers 43, and a fixing device 44.

The exposure unit 41 includes an LED head having a plurality of LEDs linearly arranged in the main scanning direction. The exposure unit 41 turns on/off the LEDs in accordance with an image signal output from the control unit 80, thereby exposing an outer peripheral surface of a photosensitive drum 42*c*.

In the meantime, the exposure unit 41 may be configured by a polygon mirror which deflects a light emitted from a light source, an optical system which forms an image on the surface of the photosensitive drum 42*c* using the light deflected by the polygon mirror, and the like.

The process cartridge 42 includes a cartridge frame 42*a*, four chargers 42*b*, and four photosensitive drums 42*c*.

The cartridge frame 42*a* is detachably mounted to the printer 1. The cartridge frame 42*a* is detachably mounted with toner cartridges 60 (60C, 60M, 60Y, 60K) of four colors of cyan (C), magenta (M), yellow (Y) and black (K).

The charger 42*b* is a scorotron-type charger, for example, and uniformly, positively charges the outer peripheral surface of the photosensitive drum 42*c*. After the outer peripheral surface of the photosensitive drum 42*c* is charged by the charger 42*b*, the outer peripheral surface of the photosensitive drum 42*c* is exposed by the light emitted from the exposure unit 41, so that an electrostatic latent image is formed on the outer peripheral surface of the photosensitive drum 42*c*. The electrostatic latent image formed on the outer peripheral surface of the photosensitive drum 42*c* is developed by toner which is supplied from the toner cartridge 60, and a toner image is carried on the surface of the photosensitive drum 42*c*. The toner is an example of colorant.

The transfer rollers 43 are respectively provided at positions facing the respective photosensitive drums 42*c* with the conveyance belt 35 being interposed therebetween. While the sheet M, which is conveyed by the belt unit 32, passes through transfer positions between the photosensitive drums 42*c* and the transfer rollers 43, the toner images carried on the respective photosensitive drums 42*c* are sequentially transferred to the sheet M by a negative transfer bias applied to the transfer rollers 43.

Here, the exposure unit 41, the charger 42*b*, the photosensitive drum 42*c* and the transfer roller 43, which correspond to one color, configure one process unit. That is, the image forming unit 40 includes four process units corresponding to four colors of CMYK.

The fixing device 44 includes a heating roller 44*a* having a heating source such as a halogen lamp accommodated therein, and a driven roller 44*b* which is rotated with being pressure-contacted to the heating roller 44*a* and heat-fixes the toner images transferred on the sheet M.

The sheet M having the toner images heat-fixed thereon is discharged to a sheet discharge tray configured by the opening/closing cover 11.

The cleaning unit 50 is arranged below the belt unit 32. The cleaning unit 50 includes a plurality of rollers. The plurality of roller includes a cleaning roller 51 which collects toner or paper powders remaining on the conveyance belt 35.

The optical sensor 70 includes a light emission unit 70*a* (refer to FIG. 3) which emits light towards an outer peripheral surface of the conveyance belt 35 at a downstream side in the conveying direction of the sheet M, and a light receiving unit 70*b* (refer to FIG. 3) which receives the light emitted from the light emission unit 70*a* and reflected on the outer peripheral surface of the conveyance belt 35 and outputs an output signal corresponding to brightness of the light received by the light receiving unit 70*b* to the control unit 80. The optical sensor 70 is an example of a sensor which detects an image formed on the rotation member. In the meantime, the optical sensor 70 includes a part (hereinafter, referred to as an optical axis) at which the light illuminated from the optical sensor 70 is brightest. However, a deviation may be caused for the optical axis due to a manufacturing error.

(2) Electrical Configuration of Printer

Figure 2:
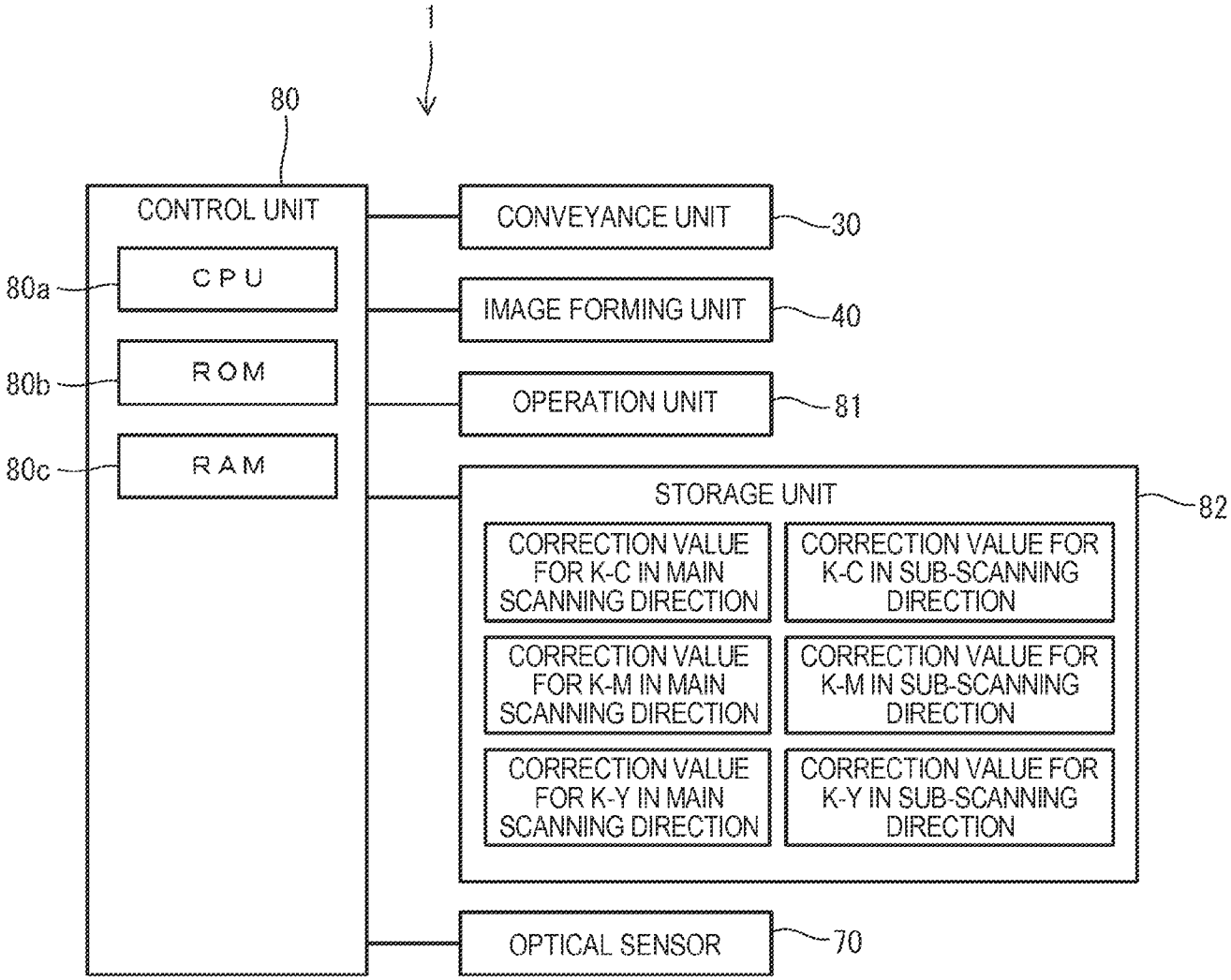
FIG. 2 is a block diagram showing an electrical configuration of the printer.

In the below, an electrical configuration of the printer 1 is described with reference to FIG. 2. The printer 1 includes the control unit 80, the conveyance unit 30, the image forming unit 40, an operation unit 81, a storage unit 82, the optical sensor 70, and the like. Since the conveyance unit 30, the image forming unit 40 and the optical sensor 70 have been already described, the descriptions thereof are omitted.

The control unit 80 (an example of a controller) includes a CPU 80*a*, a ROM 80*b*, and a RAM 80*c*. The CPU 80*a* executes a variety of control programs stored in the ROM 80*b* or storage unit 82, thereby controlling the respective units of the printer 1. The ROM 80*b* stores therein the control programs which are executed by the CPU 80*a*, a variety of data and the like. The RAM 80*c* is used as a main storage device so as for the CPU 80*a* to execute a variety of processing.

The operation unit 81 includes a liquid crystal display, a button and the like. A user can make a variety of settings such as operation mode of the image forming unit 40, an instruction of generating a correction value (which will be described later) and the like by operating the operation unit 81.

The operation mode of the image forming unit 40 may include a high definition mode and a low definition mode. The high definition mode is an operation mode in which a number of dots per one pixel is larger than that in the low definition mode.

As described above, the user can make an instruction of generating a correction value (which will be described later) by operating the operation unit 81. A processing in which the control unit 80 controls the operation unit 81 and receives an instruction of generating a correction value from a user is an example of an instruction reception processing.

In the meantime, the setting or instruction may be made from an external computer which is connected in communication with the printer 1 through a communication cable such as USB and IEEE1284 or an external computer which is connected in communication with the printer 1 through a communication network such as LAN (Local Area Network) and Internet.

The storage unit 82 (an example of a storage device) is a device which stores therein a variety of programs and data using a hard disk or a non-volatile memory such as flash memory. In the storage unit 82, numerical values, which indicate forming positions of the toner images formed by the image forming unit 40 in the main scanning direction and the sub-scanning direction, are stored. By rewriting the numerical values, the forming positions of the toner images formed by the image forming unit 40 can be adjusted.

(3) Detection of Positional Deviation Amount

In the printer 1, positions of the toner images of the respective colors may be deviated due to various causes. For example, when a position of the process unit is physically deviated, a position of the toner image may be deviated. The cause that the position of the process unit is deviated may include vibration which is caused when a user opens/closes the opening/closing cover 11, for example.

Thus, when a 'condition of executing detection of a positional deviation amount' (which will be described later) is satisfied, the control unit 80 detects a positional deviation amount of a toner image of each color in the main scanning direction and a relative positional deviation amount of a toner image of another color with respect to a toner image of a reference color in the sub-scanning direction. The 'condition of executing detection of a positional deviation amount' includes following conditions, for example.

(a1) The conveyance belt 35 is replaced.

(a2) A number of printed sheets after a correction value of a previous time is generated reaches a first predetermined number of sheets.

(a3) In the low definition mode, an instruction of generating a correction value is received from a user.

(a4) A number of printed sheets after a positional deviation amount of a previous time is detected reaches a second predetermined number of sheets.

(a5) A printing operation is first executed after the opening/closing cover 11 is opened/closed The correction value in the conditions (a2) and (a3) will be described later.

In the meantime, the above conditions are mere exemplary. That is, which kind of condition for detecting whether to detect a positional deviation amount can be appropriately determined.

The control unit 80 adjusts forming positions of toner images in the main scanning direction and the sub-scanning direction, which are formed by the image forming unit 40, using the detected positional deviation amount such that positional deviations of the toner images of respective colors are reduced.

The positional deviation amount detection is carried out by forming a pattern for positional deviation amount detection on the outer peripheral surface of the conveyance belt 35. The pattern for positional deviation amount detection is formed in an area on the conveyance belt 35 passing through an area 130 (refer to FIG. 3) which is detectable by the optical sensor 70.

In the first illustrative embodiment, the control unit 80 uses a non-overlapping pattern and an overlapping pattern as the pattern for positional deviation amount detection. In the below descriptions, black (K) is exemplified as the reference color. In the meantime, the reference color is not limited to black (K) and can be appropriately determined.

(3-1) Non-Overlapping Pattern

Figure 3:
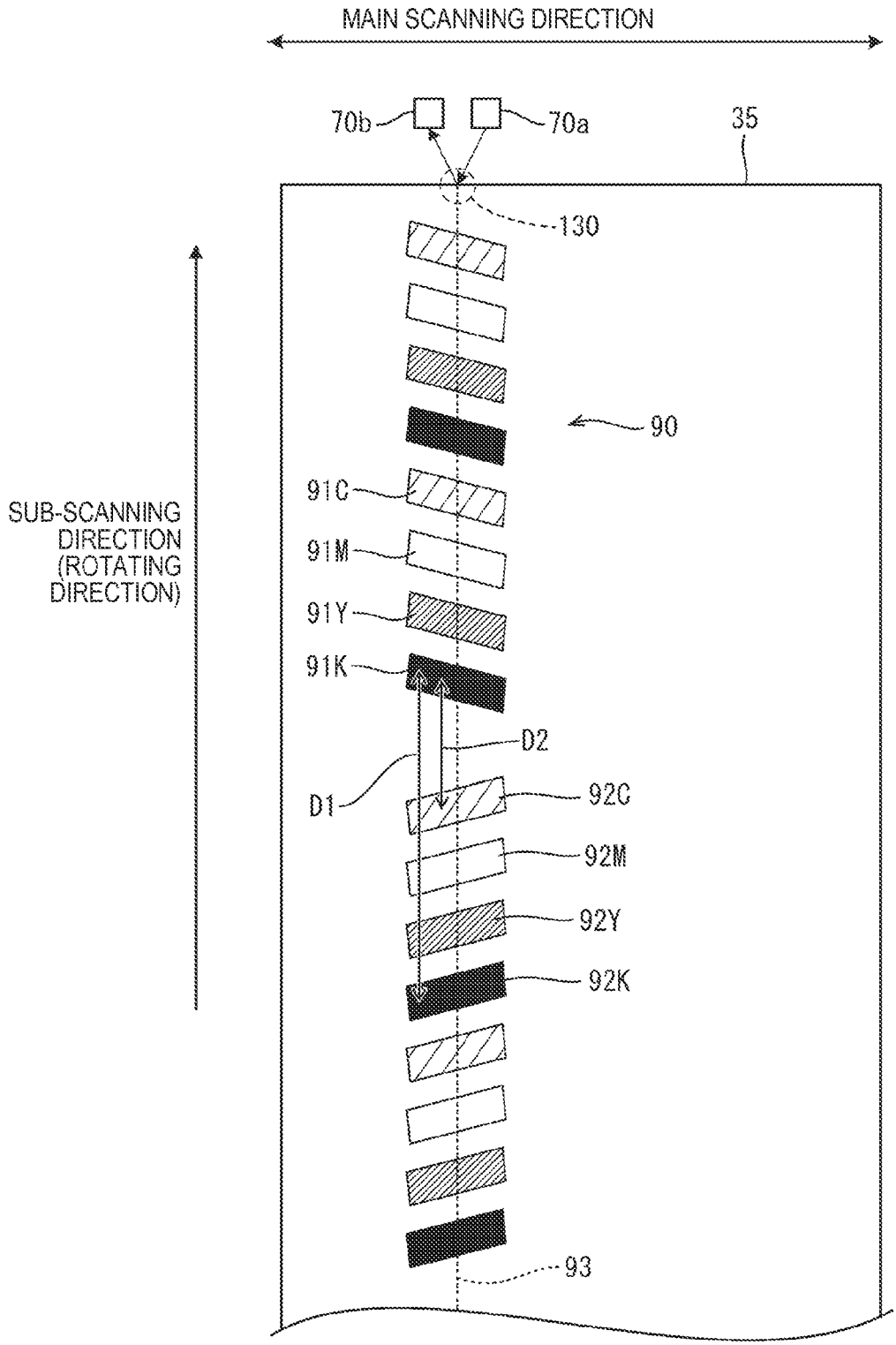
FIG. 3 is a schematic view showing a non-overlapping pattern configured by four colors.

The non-overlapping pattern is described with reference to FIG. 3. A non-overlapping pattern 90 is a pattern including a plurality of marks, each of which has a single color different from each other, and which are arranged at an interval between the marks so as not to overlap with each other in the rotating direction of the conveyance belt 35. In FIG. 3, the detection area 130 is schematically shown as a detection area which is detected by the optical sensor 70.

The non-overlapping pattern 90 shown in FIG. 3 includes a mark group having marks 91 inclined in a right-lower direction and a mark group having marks 92 inclined in a left-lower direction. The mark group inclined in the right-lower direction has two sets, each of which includes a cyan mark 91C, a magenta mark 91M, a yellow mark 91Y and a black mark 91K, which are arranged in this order. The mark group inclined in the left-lower direction also has two sets, each of which includes a cyan mark 92C, a magenta mark 92M, a yellow mark 92Y and a black mark 92K, which are arranged in this order. In FIG. 3, a dotted line 93 indicates a position at which the distance between the marks is detected by the optical sensor 70.

Meanwhile, FIG. 3 shows that the mark group inclined in the right-lower direction and the mark group inclined in the left-lower direction have two sets, respectively. However, the mark groups are formed over an entire circumference of the conveyance belt 35 and a positional deviation amount is calculated from an average value thereof. This is also the same as the overlapping pattern, which will be described later.

(3-1-1) Detection of Positional Deviation Amount in Main Scanning Direction

The detection of the positional deviation amount in the main scanning direction using the non-overlapping pattern 90 is performed using the marks 91 inclined in the right-lower direction and the marks 92 inclined in the left-lower direction for each color.

For example, for black (K), the control unit 80 detects a distance D1 between a central point of the mark 91K, which is inclined in the right-lower direction, in the sub-scanning direction and a central point of the mark 92K, which is inclined in the left-lower direction, in the sub-scanning direction, based on an output signal of the sensor. In this case, when the black (K) mark is deviated in the main scanning direction, the detected distance D1 is different from a distance (referred to as a first reference distance) which should be originally detected. The control unit 80 compares the detected distance D1 and the first reference distance, thereby determining how large and in which side of the main scanning direction the black mark is positionally deviated.

(3-1-2) Detection of Positional deviation Amount in Sub-Scanning Direction

Here, a case where a relative positional deviation amount of the cyan mark 92C relative to the black mark 91K, which is the reference color, is detected is described, for example. In this detection, the control unit 80 detects a distance D2 between the mark 91K and the mark 92C.

First, a case where both the black mark 91K and the cyan mark 92C are not positionally deviated in the main scanning direction is described. In this case, the control unit 80 compares the detected distance D2 and a reference distance (referred to as a second reference distance), thereby determining how large and in which side of the main scanning direction the cyan mark 92C is positionally deviated with respect to the black mark 91K.

Then, a case where the black mark 91K or the cyan (C) mark 92C or both the marks are positionally deviated in the main scanning direction is described. In this case, even when the detected distance D2 and the second reference distance are different, it cannot be determined whether the difference is caused due to the positional deviation in the main scanning direction or positional deviation in the sub-scanning direction. Therefore, the control unit 80 again calculates the second reference distances from the positional deviation amounts of the marks of the respective colors in the main scanning direction. Then, the control unit 80 compares the detected distance D2 and the second reference distance again calculated, thereby determining how large and in which side of the sub-scanning direction the cyan mark 92C is positionally deviated relative to the black mark 91K.

(3-2) Overlapping Pattern

Subsequently, the overlapping pattern is described. In detecting a positional deviation amount using the overlapping pattern, different overlapping patterns are used when detecting a positional deviation amount in the main scanning direction and when detecting a positional deviation amount in the sub-scanning direction.

(3-2-1) Detection of Positional Deviation Amount in Sub-Scanning Direction

First, the detection of a positional deviation amount in the sub-scanning direction is described with reference to FIG. 4. When detecting a positional deviation amount in the sub-scanning direction, an overlapping pattern 100 is formed. The overlapping pattern 100 includes a plurality of overlapping marks arranged in the sub-scanning direction. Each of the overlapping marks includes a toner image of a first color and a toner image of a second color overlapped on the toner image of the first color. An overlapping degree of the toner image of the first color and the toner image of the second color in the sub-scanning direction is different between the overlapping marks. Hereinafter, the overlapping pattern 100 is referred to as the sub-scanning direction overlapping pattern 100.

The overlapping marks are more specifically described with reference to FIG. 5. Here, a case where the first color is black (K) and the second color is cyan (C) is exemplified. In each overlapping mark 101, a black toner image 101K including two rectangular images of a rectangular image 101Ka and a rectangular image 101Kb. As shown, the two rectangular images 101Ka. 101Kb have the same position in the main scanning direction and are spaced in the sub-scanning direction. In the meantime, the cyan toner image 101C includes one rectangular image applied with cyan toner. In the meantime, the black toner image 101K may include only one rectangular image.

Figure 5:
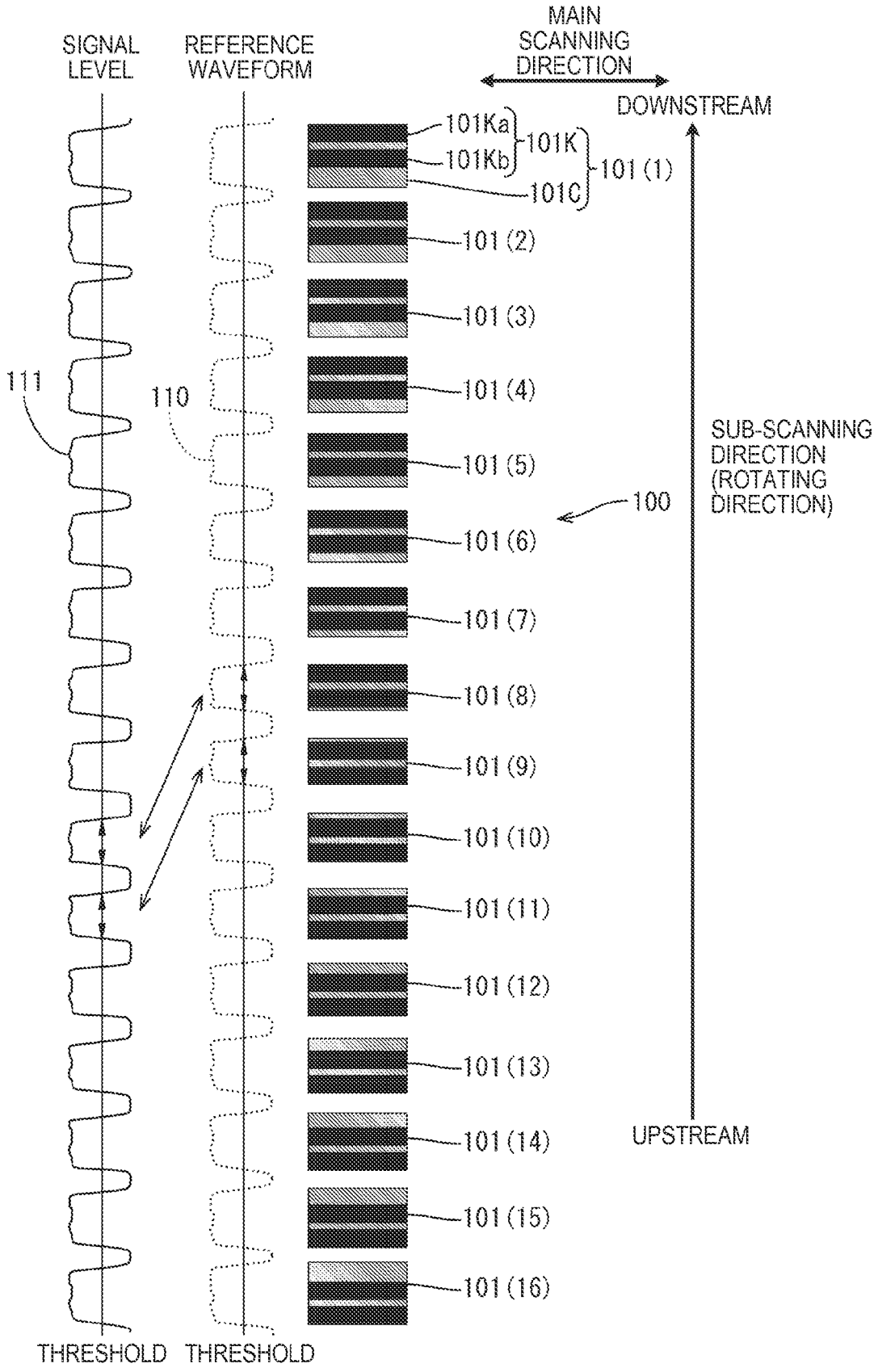
FIG. 5 is an enlarged schematic view showing the sub-scanning direction overlapping pattern.

In FIG. 5, the overlapping mark 101 (1) positioned at the most downstream side has the cyan toner image which is deviated with respect to the black toner image by about 7.5 dots towards the upstream in the sub-scanning direction. As the overlapping mark is directed towards the upstream, the position of the cyan toner image with respect to the black toner image is deviated by one dot unit towards the downstream in the sub-scanning direction. In the sixteenth overlapping mark 101 (16) that is the last mark, the cyan toner image is deviated with respect to the black toner image by about 7.5 dots towards the downstream in the sub-scanning direction.

Subsequently, an output signal is described which is output as the optical sensor 70 detects the sub-scanning direction overlapping pattern 100. Here, it is assumed that light reflectivity of the outer peripheral surface of the conveyance belt 35 is greater than those of toner images of all colors.

In FIG. 5, a dotted line 110 indicates a signal level of an output signal which is output from the optical sensor 70 when the cyan toner image is not positionally deviated with respect to the black toner image in the sub-scanning direction. That is, the dotted line 110 indicates a reference waveform.

When no positional deviation is caused, a width of the overlapping mark 101 in the sub-scanning direction is monotonically decreased from the first overlapping mark 101 (1) to the eighth overlapping mark 101 (8) and the width of the overlapping mark 101 in the sub-scanning direction is monotonically increased from the ninth overlapping mark 101 (9) to the sixteenth overlapping mark 101 (16). That is, the width of the overlapping mark 101 in the sub-scanning direction becomes minimum at the eighth overlapping mark 101 (8) and the ninth overlapping mark 101 (9).

A solid line 111 indicates a signal level of an output signal which is output from the optical sensor 70 when the cyan toner image is positionally deviated with respect to the black toner image in the sub-scanning direction.

The width in the sub-scanning direction should be originally minimum at the eighth overlapping mark 101 (8) and the ninth overlapping mark 101 (9). However, when the cyan toner image is positionally deviated with respect to the black toner image in the sub-scanning direction, the width becomes minimum at the overlapping mark 101 other than the eighth and ninth overlapping marks, such as the tenth and eleventh overlapping mark 101.

Therefore, when the width becomes minimum at the tenth and eleventh overlapping mark 101, for example, it can be determined that the cyan toner image is positionally deviated by 2 dots towards the upstream in the sub-scanning direction.

(3-2-2) Detection of Positional Deviation Amount in Main Scanning Direction

Figure 6:
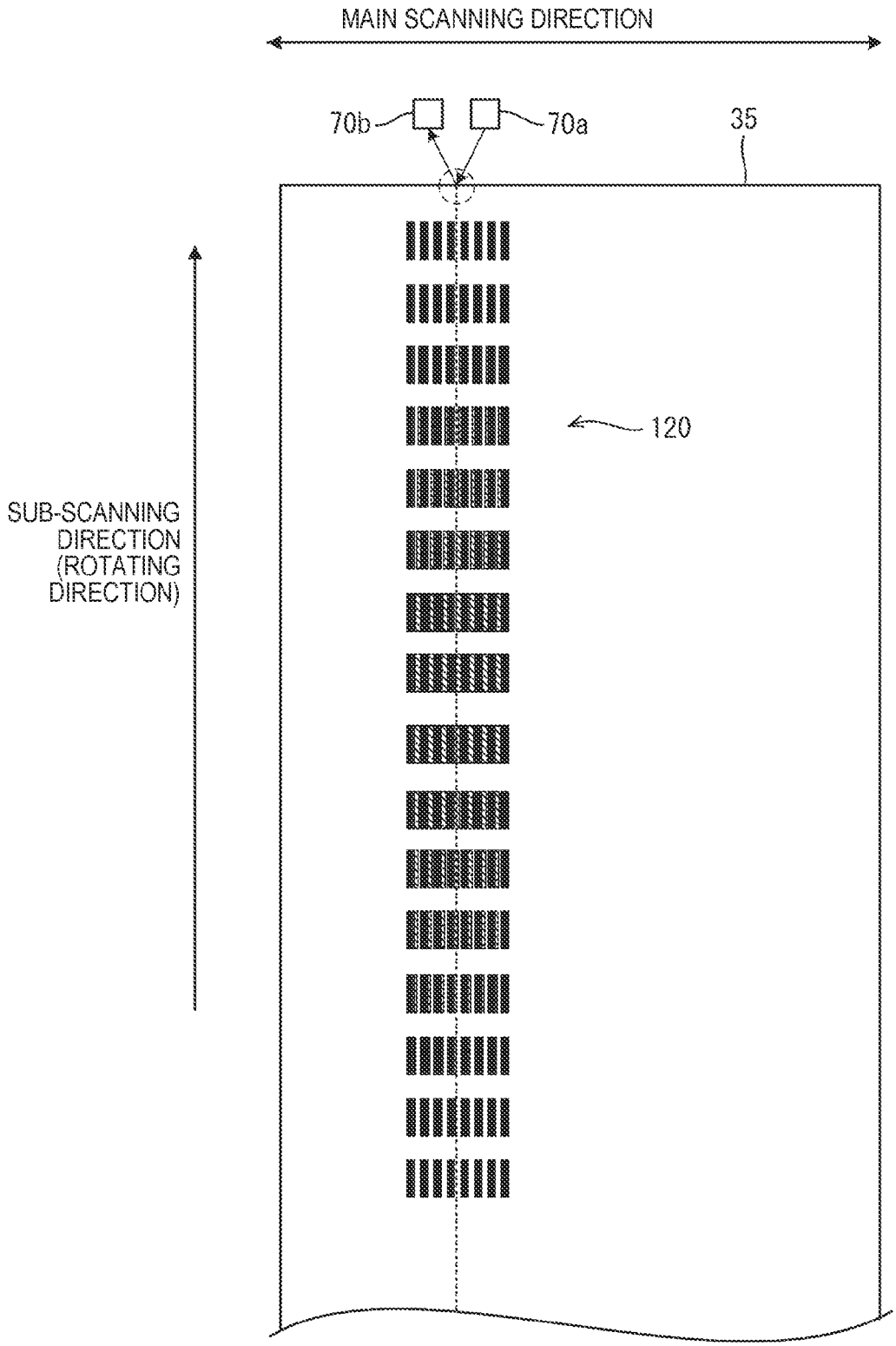
FIG. 6 is a schematic view showing a main scanning direction overlapping pattern.

Subsequently, the detection of a positional deviation amount in the main scanning direction is described with reference to FIG. 6. When detecting a positional deviation amount in the main scanning direction, an overlapping pattern 120 is formed. The overlapping pattern 120 includes a plurality of overlapping marks arranged in the sub-scanning direction. Each of the overlapping marks includes a toner image of a first color and a toner image of a second color overlapped on the toner image of the first color. An overlapping degree of the toner image of the first color and the toner image of the second color in the main scanning direction is different between the overlapping marks. Hereinafter, the overlapping pattern 120 is referred to as the main scanning direction overlapping pattern 120.

Figure 7:
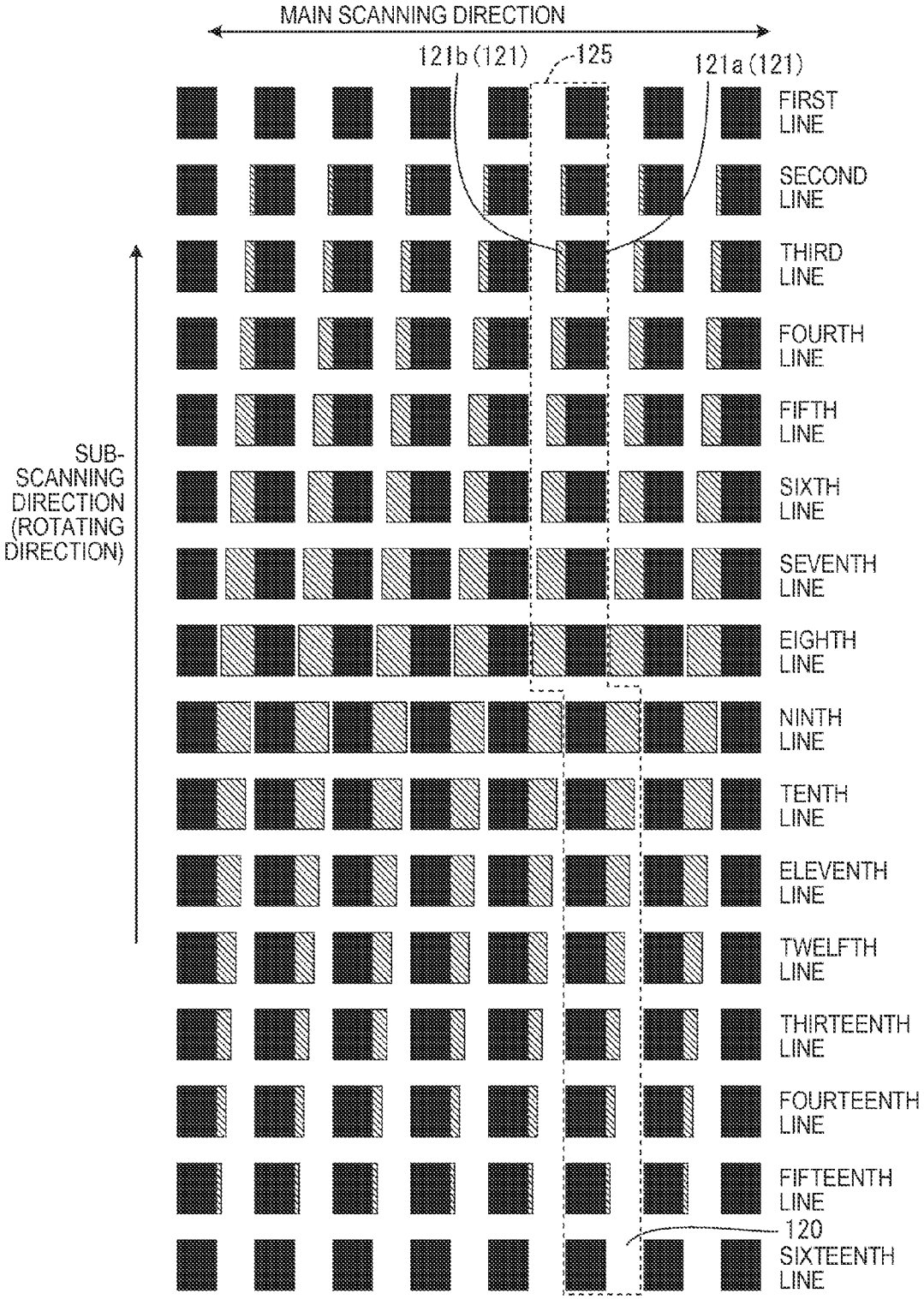
FIG. 7 is an enlarged schematic view showing the main scanning direction overlapping pattern.

The overlapping marks are more specifically described with reference to FIG. 7. For convenience, the main scanning direction overlapping pattern 120 is schematically shown in FIG. 7. When the main scanning direction overlapping pattern 120 surrounded by a dotted line 125 is referred to as the main scanning direction overlapping pattern 120 of one column, FIG. 7 shows a case where a plurality of columns of main scanning direction overlapping patterns 120 is spaced from each other and arranged in the main scanning direction. As shown in FIG. 7, in the main scanning direction overlapping pattern 120, a mark 121*a* of a first color and a mark 121*b* of a second color are formed as one rectangular image, respectively.

Figure 8:
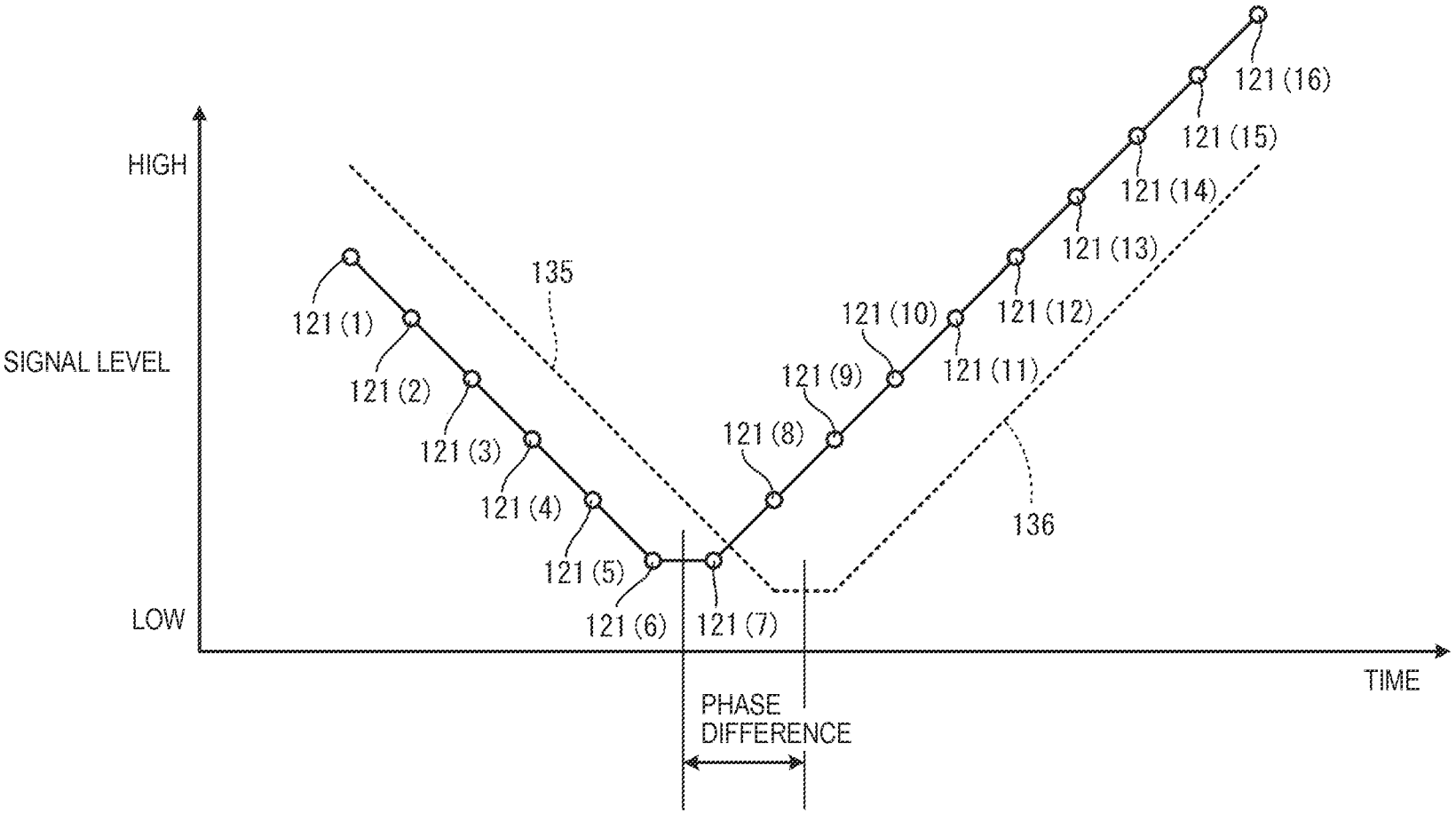
FIG. 8 shows an example of an output signal when detecting the main scanning direction overlapping pattern.

Subsequently, an output signal is described which is output as the optical sensor 70 detects the main scanning direction overlapping pattern 120. In FIG. 8, a dotted line 135 indicates a signal level of an output signal which is output from the optical sensor 70 when the cyan toner image is not positionally deviated with respect to the black toner image in the main scanning direction. That is, the dotted line 125 indicates a reference waveform.

When the light reflectivity of the outer peripheral surface of the conveyance belt 35 is high, the signal level of the output signal from the sensor is increased as an area of the mark is smaller. Therefore, when no positional deviation is caused, the signal level is monotonically decreased from a first line to an eighth line and is monotonically increased from a ninth line to a sixteenth line. That is, the signal level becomes minimum at the eighth line and the ninth line.

A solid line 136 indicates a signal level of an output signal which is output from the optical sensor 70 when the cyan toner image is positionally deviated with respect to the black toner image in the main scanning direction, and the optical sensor 70 detects the respective overlapping marks 121. The signal level should be originally minimum at the eighth line and the ninth line. However, when the cyan toner image is positionally deviated with respect to the black toner image in the main scanning direction, the signal level becomes minimum at the line other than the eighth and ninth lines, such as the sixth and seventh lines.

Therefore, when the signal level becomes minimum at the sixth and seventh lines, for example, it can be determined that the cyan toner image is positionally deviated by 2 dots towards the left side in the main scanning direction.

(4) Distinguishing Usage of Overlapping Pattern and Non-Overlapping Pattern

Figure 4:
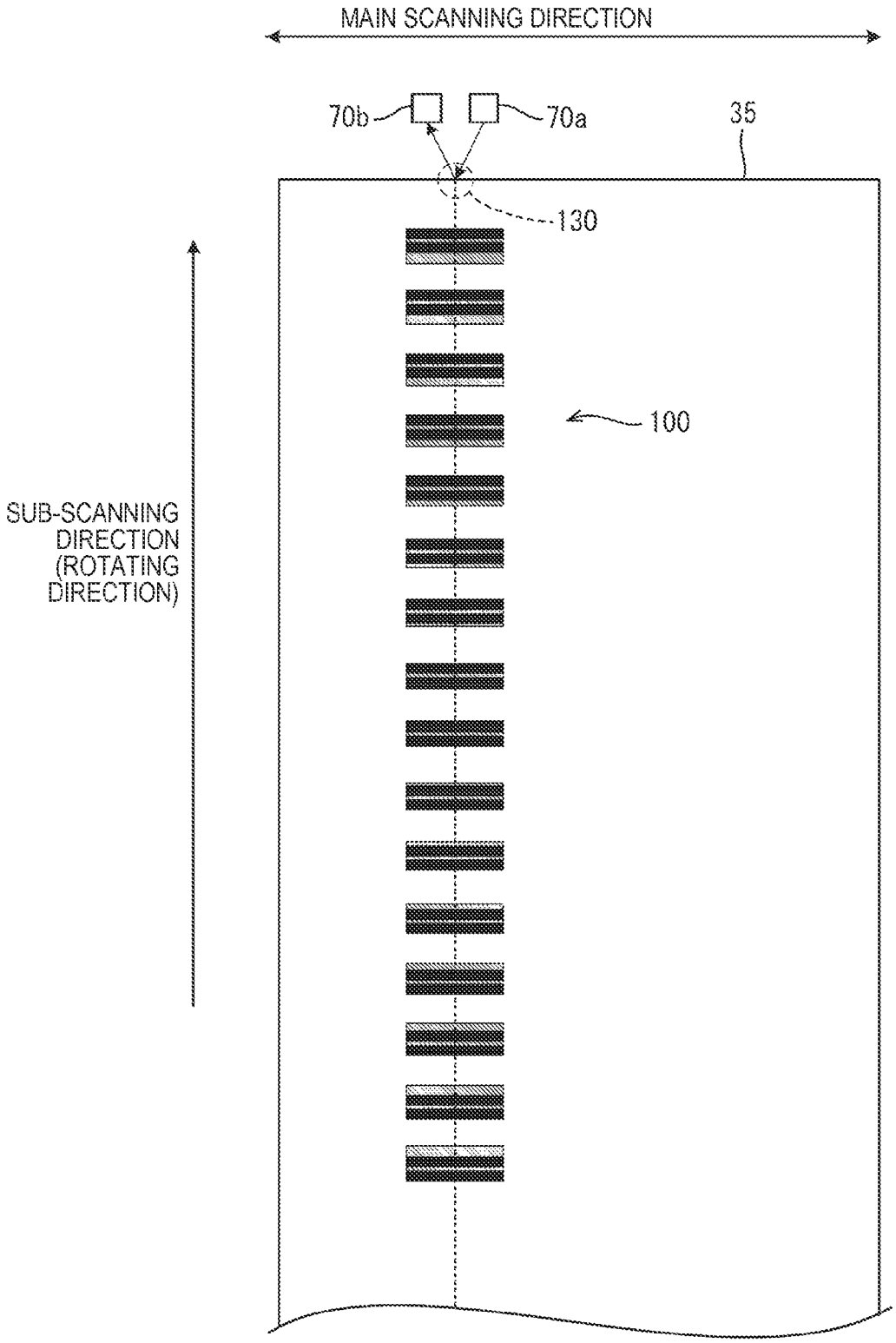
FIG. 4 is a schematic view showing a sub-scanning direction overlapping pattern.

In the sub-scanning direction overlapping pattern 100 shown in FIG. 4, it is just possible to detect the positional deviation amount of the cyan toner image relative to the black toner image in the sub-scanning direction. Therefore, in order to detect a positional deviation amount of the magenta toner image with respect to the black toner image in the sub-scanning direction and a positional deviation amount of the yellow toner image with respect to the black toner image in the sub-scanning direction, it is necessary to form the similar sub-scanning direction overlapping patterns as FIG. 4 for a combination of black (K) and magenta (M) and for a combination of black (K) and yellow (Y), respectively. Same is true to the main scanning direction. Therefore, when using the overlapping patterns, it is necessary to form a total of six patterns.

Compared to this, when using the non-overlapping pattern 90, it is possible to detect the positional deviation amounts of CMYK in the main scanning direction and the relative positional deviation amounts of the CMY toner images with respect to the black toner image in the sub-scanning direction just with the pattern shown in FIG. 3. That is, in the case of the non-overlapping pattern 90, the pattern to be formed may be one pattern. Therefore, the non-overlapping pattern 90 has advantages that an amount of toner to be used is smaller and time consumed to form the pattern is shorter, compared to the overlapping pattern.

On the other hand, the overlapping pattern has advantages that a detection error of the positional deviation amount due to a manufacturing error of the optical sensor 70 is smaller, compared to the non-overlapping pattern 90. For example, it is assumed that an optical axis of the optical sensor 70 is deviated from a designed position in the main scanning direction due to the manufacturing error. In this case, when the positional deviation amount of the mark is detected using the non-overlapping pattern 90, the positional deviation amount of the mark is acquired with a positional deviation amount of the optical axis of the optical sensor 70 being included because the non-overlapping pattern 90 is not a pattern capable of detecting the positional deviation amount of the optical axis of the optical sensor 70. Accordingly, even when the positional deviation amount is approximated to zero using the non-overlapping pattern 90, a forming position of an image is deviated as a deviation amount between the actual optical axis of the optical sensor 70 and the design optical axis thereof.

In contrast, when using the overlapping pattern, a deviation amount corresponding to a phase difference between the signal waveform (the waveform 111 or waveform 136) of the output signal and the reference waveform (the waveform 110 or waveform 135) is equivalent to a positional deviation amount of another color with respect to the reference color at a state where an influence due to the difference of the optical axis of the optical sensor 70 is excluded. Therefore, it is possible to form an image in the same manner as a case where the deviation of the optical axis of the optical sensor 70 is zero, thereby improving an image quality of the printer 1.

That is, the non-overlapping pattern 90 and the overlapping pattern have different properties. Thus, the control unit 80 distinguishingly uses the patterns to detect a positional deviation amount. Specifically, the control unit 80 detects a positional deviation amount using the overlapping pattern when the high definition mode is set and detects a positional deviation amount using the non-overlapping pattern 90 when the low definition mode is set.

The reason why the overlapping pattern is used when the high definition mode is set is that since a size per one dot is smaller in the high definition mode than in the low definition mode, it is required to control a forming position of the dot with high precision.

The 'case where the high definition mode is set' is an example of an overlapping pattern execution condition. The 'case where the low definition mode is set' is an example of a non-overlapping pattern execution condition.

Although specifically described later, in this illustrative embodiment, in order to generate a correction value, in some case, the positional deviation amount is detected using the overlapping pattern even when the low definition mode is set.

(5) Correction of Positional Deviation Amount Detected Using Non-Overlapping Pattern As described above, the non-overlapping pattern 90 cannot detect the positional deviation amount of the optical axis of the optical sensor 70, and the detection amount may be increased as the positional deviation amount of the optical axis of the optical sensor 70, compared to the overlapping pattern.

Thus, when a 'condition of generating a correction value' which will be described later is satisfied, the control unit 80 executes detection of a positional deviation amount using the overlapping pattern and detection of a positional deviation amount using the non-overlapping pattern 90 and generates correction values for colors other than the reference color in each of the main scanning direction and the sub-scanning direction from a difference of the detected positional deviation amounts.

When the low definition mode is set, the control unit corrects the positional deviation amount, which is detected using the non-overlapping pattern 90, using the generated correction value, thereby calculating a positional deviation amount equivalent to a positional deviation amount detected using the overlapping pattern. Therefore, it is possible to reduce a detection error between the case of using the non-overlapping pattern 90 and the case of using the overlapping pattern.

Specifically, for example, the control unit 80 generates a correction value for each color other than the reference color in accordance with a following Equation 1.

Correction Value=Positional deviation amount detected using the overlapping pattern−Positional deviation amount detected using the non-overlapping pattern 90 [Equation 1]

For example, it is assumed that the positional deviation amount detected using the overlapping pattern is 5 and the positional deviation amount detected using the non-overlapping pattern 90 is 2. In this case, the correction value is 3 by the Equation 1.

Then, when detecting the positional deviation amount using the non-overlapping pattern 90, the control unit 80 adds the correction value to the detected positional deviation amount, thereby correcting the positional deviation amount to be approximate to the positional deviation amount detected using the overlapping pattern.

Herein, the correction value is described by exemplifying the difference. However, the correction value may be a ratio of the positional deviation amount detected using the overlapping pattern and the positional deviation amount detected using the non-overlapping pattern 90, for example.

(5-1) Condition of Generating Correction Value

The 'condition of generating a correction value' includes following conditions, for example.

(b1) In the low definition mode, a correction value is not stored in the storage unit 82

(b2) in the low definition mode, the conveyance belt 35 is replaced (b3) in the low definition mode, a number of printed sheets after a correction value of a previous time is generated reaches a first predetermined number of sheets (b4) in the low definition mode, an instruction of generating a correction value is received from a user Here, the conditions (b2) to (b4) correspond to conditions that the limitation 'in the low definition mode' is added to the conditions (a1) to (a3) of executing the detection of the positional deviation amount.

Also, in order to determine whether the condition (b3) is satisfied, the control unit 80 stores, as a history information, the number of printed sheets in the storage unit 82 whenever a printing operation is executed. The number of printer sheets is an example of history information about the image formation. The processing in which the control unit 80 stores the number of printed sheets is an example of a storing processing. Also, 'when the number of printed sheets reaches a predetermined number of sheets' is an example of a predetermined condition. In the meantime, the control unit 80 may store, as the history information, printing conditions such as whether a color printing is performed in addition to the number of printed sheets and may determine whether to generate a correction value, considering those printing conditions.

(5-2) Estimation of Correction Value

As described above, the control unit 80 generates the correction value when the 'condition of generating a correction value' is satisfied. However, the generation method is different depending on the satisfied condition. Specifically, when the condition (b1) is satisfied, the control unit 80 generates a correction value by executing detection of a positional deviation amount using the non-overlapping pattern and detection of a positional deviation amount using the overlapping pattern for all combinations of the reference color and each one color of the other colors. All combinations of the reference color and each one color of the other colors mean a combination of black (K) and cyan (C), a combination of black (K) and magenta (M) and a combination of black (K) and yellow (Y).

Compared to the above, when the conditions (b2) to (b4) are satisfied, the control unit 80 executes detection of a positional deviation amount using the non-overlapping pattern and detection of a positional deviation amount using the overlapping pattern only for a combination of the reference color and another one color to generate a correction value for the one color and estimates correction values for the other colors except the one color from the correction value for the one color. Here, when the one color other than the reference color is cyan (C), the other colors except the one color are magenta (M) and yellow (Y). The reason is as follows.

When there is a difference between the positional deviation amount detected using the overlapping pattern and the positional deviation amount detected using the non-overlapping pattern 90 for one color, i.e., when the correction value is not 0 (zero), a cause (the manufacturing error of the sensor and the like) of the difference also has an influence on the other colors. Therefore, when a correction value for one color is large, correction values for the other colors are also large. That is, there is a correlation between a correction value generated for one color and a correction value generated for another color.

Therefore, in order to save toner and to reduce time necessary to generate a correction value, the control unit 80 estimates correction values for the other colors except one color based on the correction value generated for the one color other than the reference color.

Specifically, for example, the control unit 80 multiplies a correction value generated for one color other than the reference color by a coefficient prepared for each of the other colors except the one color, thereby estimating correction values for the other colors except the one color.

The coefficient to be multiplied can be calculated by previously generating correction values for all colors except the reference color and taking a ratio of the correction value for the one color of all colors other than the reference color and a correction value of another color except the one color, for example. In the ROM **80*b*, ratios calculated in advance by a test are stored as coefficients for each of the other colors except the one color. The control unit 80** estimates correction values by multiplying the coefficients.

In the meantime, instead of storing the coefficients in the ROM **80*b* in advance, the correction values may be generated for each of the colors other than the reference color using the overlapping pattern and the non-overlapping pattern 90 for all combinations of the reference color and each one color of the other colors, and ratios between the generated correction values may be stored as the coefficients in the storage unit 82**.

Also, the case where the correction value is estimated by multiplying the coefficient is here described. However, the correction value may be estimated by adding the coefficient or referring to a table where a correction value for one color and correction values for other colors except the one color. The estimating method can be appropriately selected.

(6) Positional Deviation Amount Detection/Adjustment Processing Executed by Control Unit In the below, a positional deviation amount detection/adjustment processing which is executed by the control unit 80 when the 'condition of executing detection of a positional deviation amount' is satisfied is described with reference to FIG. 9.

In S101, the control unit 80 determines whether the high definition mode is set as the operation mode. When the high definition mode is set, the control unit proceeds to S102 and when the low definition mode is set, the control unit 80 proceeds to S106.

In S102, the control unit 80 detects a positional deviation amount in the sub-scanning direction for all combinations of the reference color and each one color of the other colors using the sub-scanning direction overlapping pattern 100. The processing of S102 is an example of an overlapping pattern detection processing.

In S103, the control unit 80 rewrites numerical values, which indicate sub-scanning direction forming positions of toner images formed by the image forming unit 40, based on the positional deviation amount detected in S102, thereby adjusting the forming position. Specifically, for example, the control unit 80 adjusts sub-scanning direction timings, at which the process unit of a color other than black (K) starts the exposure, in accordance with the positional deviation amount such that the relative positional deviation of the toner image of another color with respect to the black toner image is reduced. The sub-scanning direction timing at which the process unit starts the exposure is an example of a numerical value, which indicates the forming position of the toner image in the sub-scanning direction, and the processing of S103 is an example of an adjustment processing.

In S104, the control unit 80 detects a positional deviation amount in the main scanning direction for all combinations of the reference color and each one color of the other colors using the main scanning direction overlapping pattern 120.

In S105, the control unit 80 rewrites numerical values, which indicate the main scanning direction forming positions of the toner images formed by the image forming unit 40, based on the positional deviation amount detected in S104. Specifically, for example, the control unit 80 adjusts a main scanning direction timing, at which the process unit of each color starts the exposure, in accordance with the positional deviation amount. The main scanning direction timing at which the process unit starts the exposure is an example of a numerical value, which indicates the forming position of the toner image in the main scanning direction, and the processing of S105 is an example of an adjustment processing.

In S106, the control unit 80 determines whether the condition (b1) of generating a correction value is satisfied. For example, after factory shipment, when a printing operation is first performed in the low definition mode, a correction value has not been stored. When a correction value has not been stored, the control unit 80 determines that the condition (b1) is satisfied and proceeds to S107. Otherwise, the control unit proceeds to S108.

In S107, the control unit 80 executes a first non-overlapping pattern adjustment processing. The first non-overlapping pattern adjustment processing is a processing of executing a processing of detecting a positional deviation amount using the non-overlapping pattern 90, a processing of adjusting a forming position of a toner image based on the detected positional deviation amount, a processing of executing the overlapping pattern detection processing and a non-overlapping pattern detection processing for all combinations of the reference color and each one color of the other colors to thus generate a correction value for each of the other colors, and the like. The first non-overlapping pattern adjustment processing will be specifically described later.

In S108, the control unit 80 determines whether any one of the conditions (a1) to (a3) is satisfied. Since it is determined in S101 that the operation mode is the low definition mode, when any one of the conditions (a1) to (a3) is satisfied, any one of the conditions (b2) to (b4) of generating a correction value is satisfied. Compared to this, when the condition (a4) or (a5) is satisfied and this processing is executed, the 'condition of generating a correction value' is not satisfied.

When any one of the conditions (a1) to (a3) is satisfied, the control unit 80 proceeds to S109. Otherwise, the control unit proceeds to S110.

In S109, the control unit 80 executes a second non-overlapping pattern adjustment processing. The second non-overlapping pattern adjustment processing is a processing of executing a processing of detecting a positional deviation amount using the non-overlapping pattern 90, a processing of adjusting a forming position of a toner image based on the detected positional deviation amount, a processing of executing the overlapping pattern detection processing and non-overlapping pattern detection processing for a combination of the reference color and another one color to generate a correction value for the one color, a processing of estimating correction values for other colors except the one color from the correction value for the one color, and the like. The second non-overlapping pattern adjustment processing will be specifically described later.

In S110, the control unit 80 detects positional deviation amounts in the sub-scanning direction and the main scanning direction for all the colors using the non-overlapping pattern 90. The processing of S110 is an example of a non-overlapping pattern detection processing.

In S111, the control unit 80 corrects the positional deviation amounts detected in S110 for the other colors other than the reference color using the correction values stored in the storage unit 82. The processing of S111 is an example of a correction processing. The correction values stored in the storage unit 82 has been stored in the storage unit 82 by the first non-overlapping pattern adjustment processing or the second non-overlapping pattern adjustment processing.

In S112, the control unit 80 rewrites the numerical values, which indicate the main scanning direction forming positions of the toner images formed by the image forming unit 40, and the numerical values indicating the forming positions in the sub-scanning direction based on the positional deviation amounts corrected in S111 such that a center of the detection area 130 coincides with the central axis of the non-overlapping pattern. The processing of S112 is an example of an adjustment processing.

(6-1) First Non-Overlapping Pattern Adjustment Processing

Subsequently, the first non-overlapping pattern adjustment processing which is executed in S107 is described with reference to FIG. 10. The substantially same processing as the processing shown in FIG. 9 is denoted with the same reference numeral and the description thereof is omitted.

Figure 9:
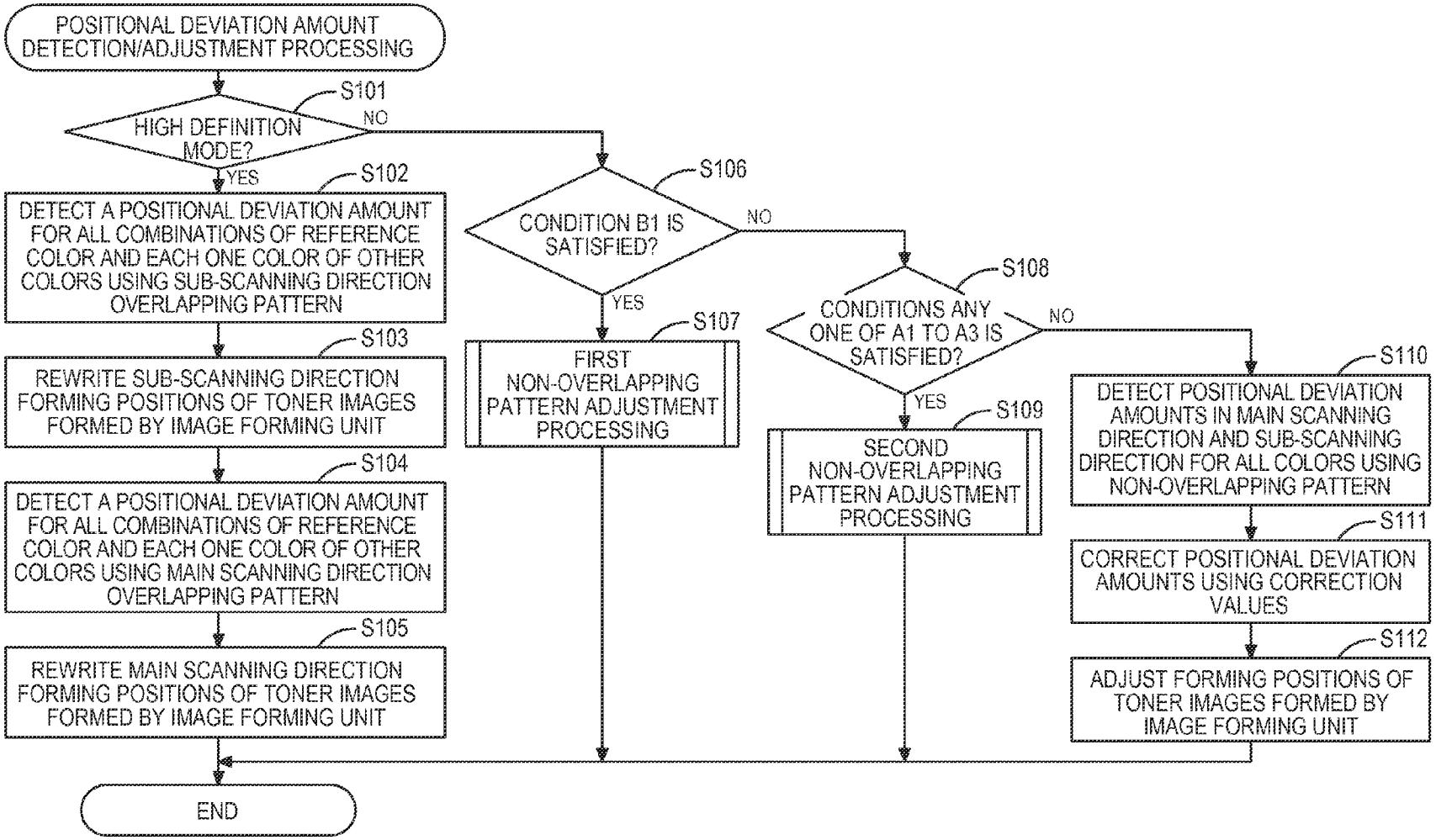
FIG. 9 is a flowchart showing a positional deviation amount detection/adjustment processing.
Figure 10:
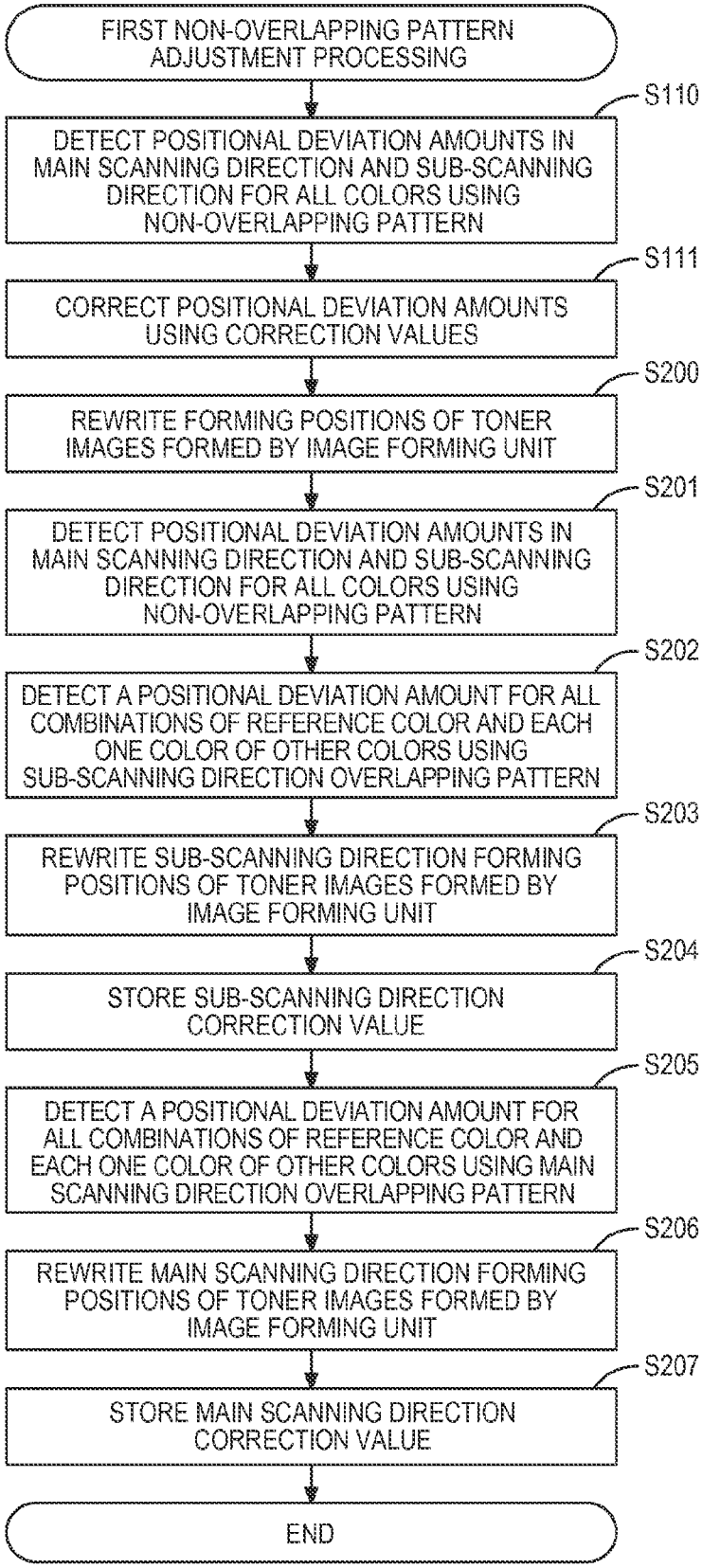
FIG. 10 is a flowchart showing a first non-overlapping pattern adjustment processing.

Since the processing of S110 and S111 is substantially same as the processing shown in FIG. 9, the description thereof is omitted. However, in S111 of the first non-overlapping pattern adjustment processing, since a correction value has not yet been stored in the storage unit 82, 0 is used as a correction value. In the meantime, in the first non-overlapping pattern adjustment processing, the processing of S111 may not be executed.

In S200, the control unit 80 rewrites the numerical values, which indicate the forming positions of the toner images formed by the image forming unit 40 in the main scanning direction, and the numerical values indicating the forming positions in the sub-scanning direction based on the positional deviation amounts corrected in S111 such that the center of the detection area 130 coincides with the central axis of the non-overlapping pattern. The processing of S200 is an example of an adjustment processing.

In the first non-overlapping pattern adjustment processing, a positional deviation amount may be large because the control unit is at the state where a correction value has not been stored. Therefore, it is preferable to detect the positional deviation like the processing of S110. For example, in S110, it is assumed that there is a deviation of 30 dots in the main scanning direction and a deviation of 30 dots in the sub-scanning direction for a combination of black (K) and cyan (C). In this case, the control unit subtracts the numerical value, which indicates the forming position in the main scanning direction, by a numerical value corresponding to 30 dots and subtracts the numerical value, which indicates the forming position in the sub-scanning direction, by a numerical value corresponding to 30 dots such that the center of the detection area 130 coincides with the central axis of the non-overlapping pattern in S200. Here, it is assumed that the deviation amount of the optical axis of the optical sensor 70 still remains and there are a deviation of 1 dot in the main scanning direction and a deviation of 1 dot in the sub-scanning direction.

In S201, in order to acquire the positional deviation amount detected using the non-overlapping pattern 90, which is used for the calculation of the Equation 1, the control unit 80 again detects positional deviation amounts in the sub-scanning direction and the main scanning direction for all the colors using the non-overlapping pattern 90. Since the numerical values are rewritten in S200, the control unit 80 detects in S201 that there are a deviation of 0 dot in the main scanning direction and a deviation of 0 dot in the sub-scanning direction. In the meantime, the control unit 80 repeats the detection twice and calculates an average value thereof as the positional deviation amount. In this case, however, the positional deviation amount is just detected and the forming position of the toner image is not adjusted.

In S202, the control unit 80 detects a positional deviation amount in the sub-scanning direction for all combinations of the reference color and each one color of the other colors using the sub-scanning direction overlapping pattern 100. In S202, the control unit 80 detects that there is a deviation of 1 dot in the sub-scanning direction, which corresponds to the deviation amount of the optical axis of the optical sensor 70.

In S203, the control unit 80 rewrites the numerical values, which indicate the sub-scanning direction forming positions of the toner images formed by the image forming unit 40, based on the positional deviation amount detected in S202. In S203, the control unit subtracts the numerical values, which indicate the forming positions in the sub-scanning direction, by a numerical value corresponding to 1 dot.

In S204, the control unit 80 stores a difference between the positional deviation amount in the sub-scanning direction, which is detected using the non-overlapping pattern 90 in S201, and the positional deviation amount in the sub-scanning direction, which is detected using the sub-scanning direction overlapping pattern 100 in S202, for each of the colors other than the reference color, in the storage unit 82 as a sub-scanning direction correction value for the corresponding color. In S204, a value of −1 dot in the sub-scanning direction is stored in the storage unit 82.

In S205, the control unit 80 detects a positional deviation amount in the main scanning direction for all combinations of the reference color and each one color of the other colors using the main scanning direction overlapping pattern 120. In S205, the control unit 80 detects that there is a deviation of 1 dot in the main scanning direction, which corresponds to the deviation amount of the optical axis of the optical sensor 70.

In S206, the control unit 80 rewrites the numerical values, which indicate the main scanning direction forming positions of the toner images formed by the image forming unit 40, based on the positional deviation amount detected in S205. In S206, the control unit subtracts the numerical values, which indicate the forming positions in the main scanning direction, by a numerical value corresponding to 1 dot.

In S207, the control unit 80 stores a difference between the positional deviation amount in the main scanning direction, which is detected using the non-overlapping pattern 90 in S201, and the positional deviation amount in the main scanning direction, which is detected using the main scanning direction overlapping pattern 120 in S205, for each of the colors other than the reference color, in the storage unit 82 as a main scanning direction correction value. In S207, a value of −1 dot in the main scanning direction is stored in the storage unit 82.

The processing of S201 to S207 is an example of a correction value generation processing.

(6-2) Second Non-Overlapping Pattern Adjustment Processing

Subsequently, the second non-overlapping pattern adjustment processing which is executed in S109 is described with reference to FIGS. 11 and 12. Here, cyan (C) is exemplified as one color other than the reference color. The substantially same processing as the processing shown in FIG. 9 is denoted with the same reference numeral and the description thereof is omitted.

Figure 11:
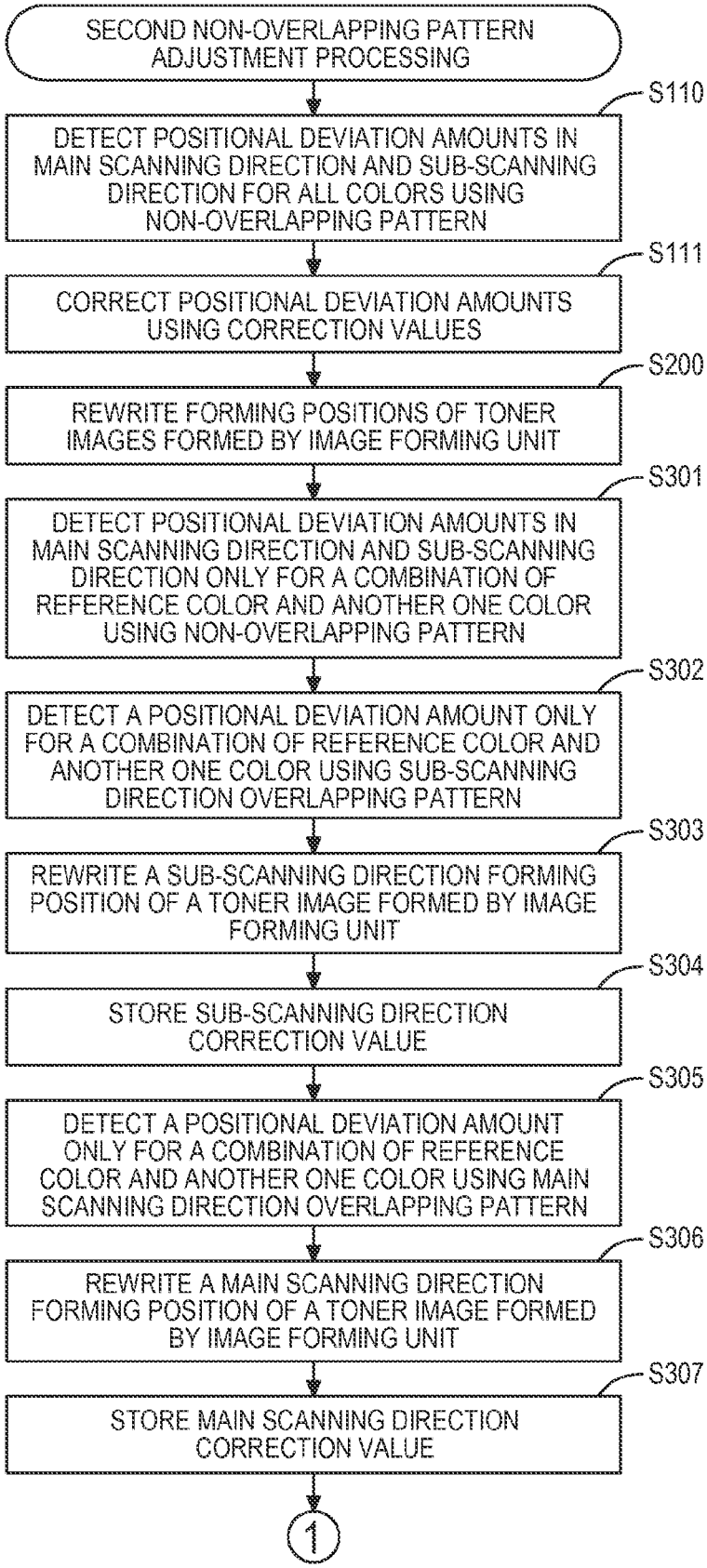
FIG. 11 is a flowchart showing a first part of a second non-overlapping pattern adjustment processing.
Figure 12:
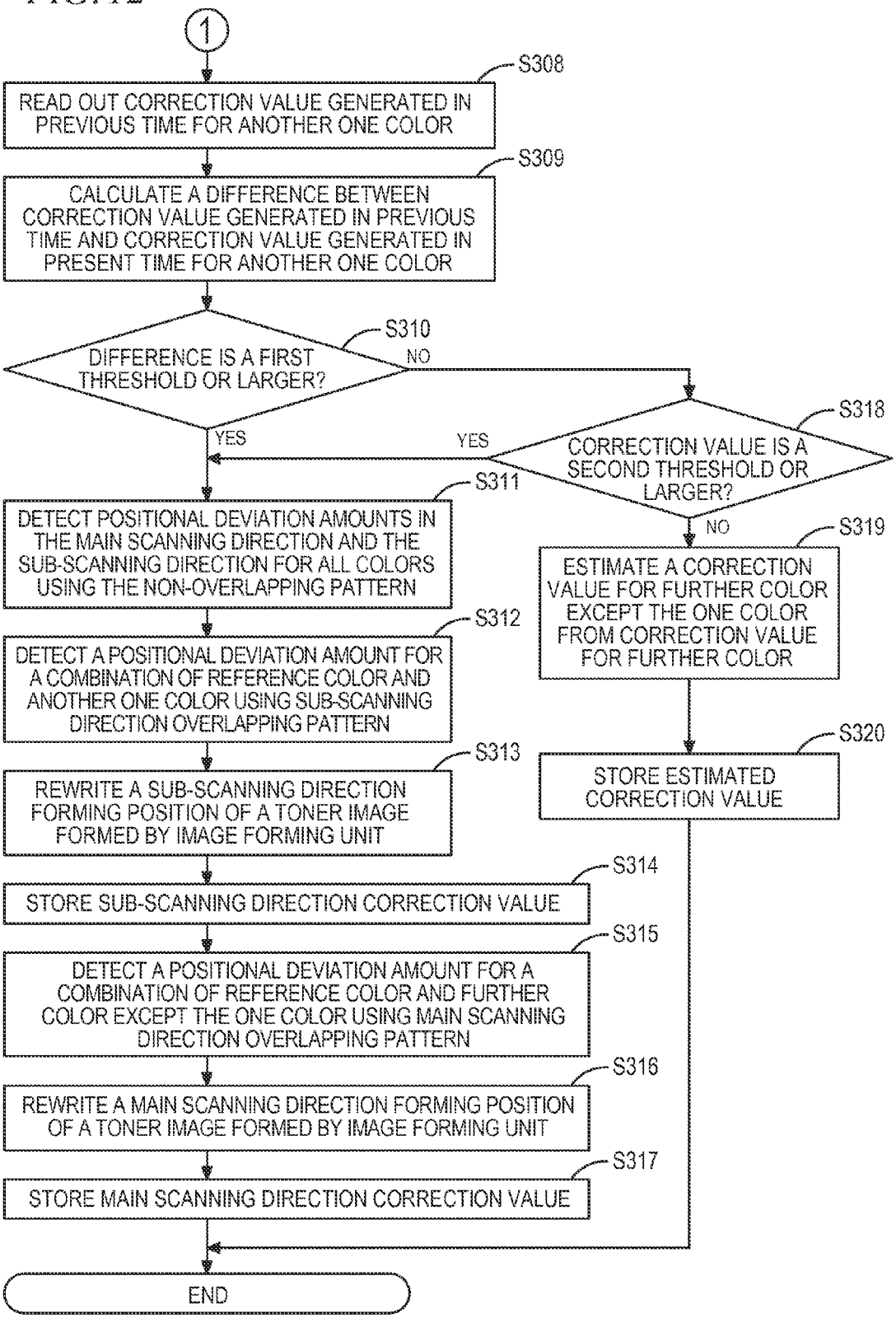
FIG. 12 is a flowchart showing a second part of the second non-overlapping pattern adjustment processing.

Since the processing of S110 and S111 is substantially same as the processing shown in FIG. 9 and the processing of S200 is substantially same as the processing shown in FIG. 11, the descriptions thereof are omitted.

In S301, in order to acquire the positional deviation amount detected using the non-overlapping pattern 90, which is used for the calculation of the Equation 1, the control unit 80 detects the positional deviation amounts in the sub-scanning direction and the main scanning direction only for a two-color combination of black (K) and cyan (C) using the non-overlapping pattern 90.

Figure 13:
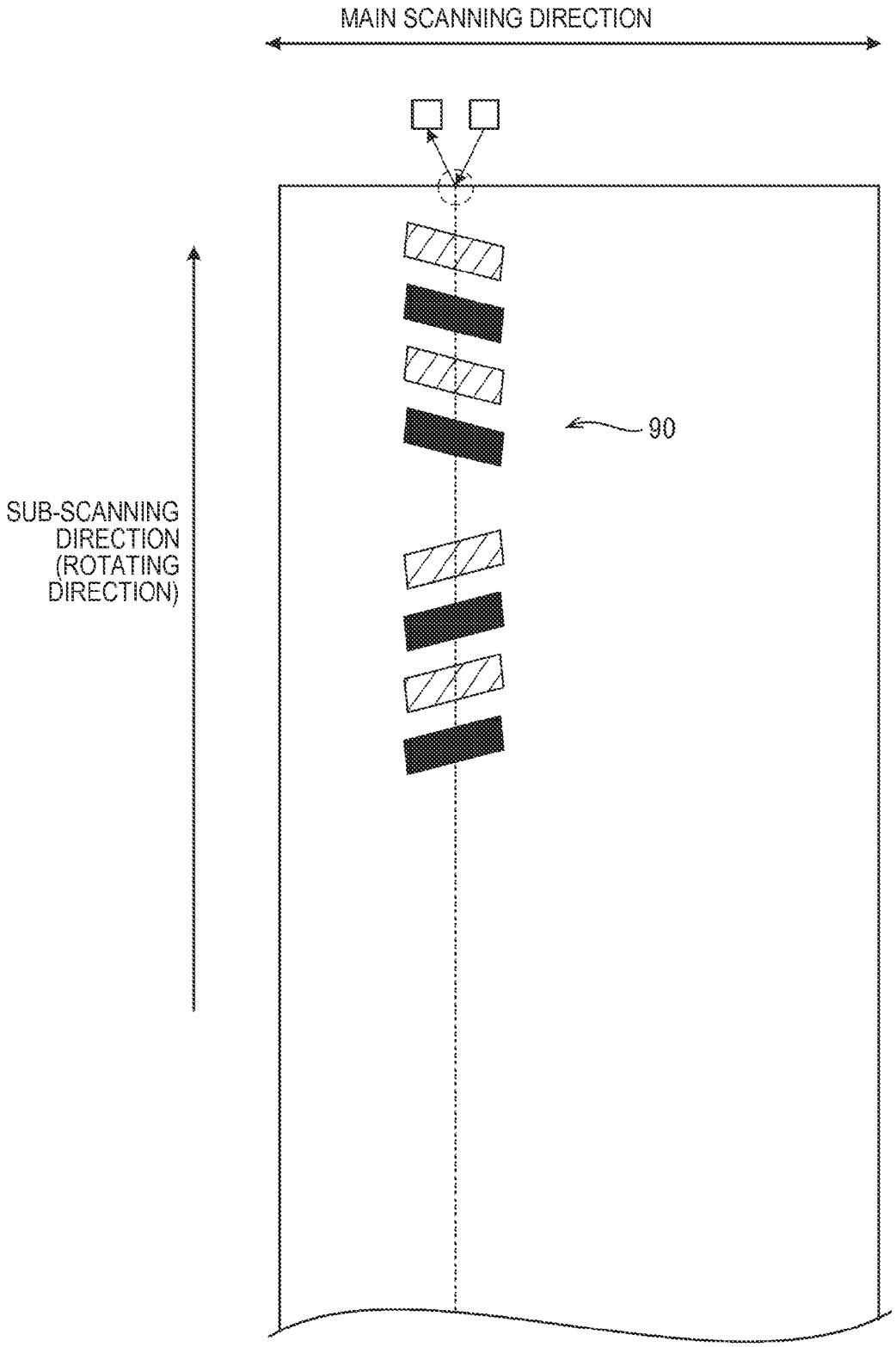
FIG. 13 is a schematic view showing a non-overlapping pattern configured by two colors.

Here, it is assumed that the non-overlapping pattern 90 using only two colors of black (K) and cyan (C) is used in S301, as shown in FIG. 13. The reason is to prevent a color mark, which does not detect a positional deviation amount, from being formed. The control unit 80 repeats the detection twice and calculates an average value thereof as the positional deviation amount in S301. In this case, the positional deviation amount is just detected and the forming position of the toner image is not adjusted.

In S302, the control unit 80 detects a positional deviation amount in the sub-scanning direction only for a combination of black (K) and cyan (C) using the sub-scanning direction overlapping pattern 100.

In S303, the control unit 80 rewrites the numerical value, which indicates the sub-scanning direction forming position of the cyan toner image formed by the image forming unit 40, based on the positional deviation amount detected in S302.

In S304, the control unit 80 stores a difference between the positional deviation amount in the sub-scanning direction, which is detected using the non-overlapping pattern 90 in S301, and the positional deviation amount in the sub-scanning direction, which is detected using the sub-scanning direction overlapping pattern 100 in S302, in the storage unit 82 as a sub-scanning direction correction value for cyan (C).

In S305, the control unit 80 detects a positional deviation amount in the main scanning direction only for a combination of black (K) and cyan (C) using the main scanning direction overlapping pattern 120.

In S306, the control unit 80 rewrites the numerical value, which indicates the main scanning direction forming position of the cyan toner image formed by the image forming unit 40, based on the positional deviation amount detected in S302.

In S307, the control unit 80 stores a difference between the positional deviation amount in the main scanning direction, which is detected using the non-overlapping pattern 90 in S301, and the positional deviation amount in the main scanning direction, which is detected using the main scanning direction overlapping pattern 120 in S306, for each of black (K) and cyan (C), in the storage unit 82 as a main scanning direction correction value.

In S308, the control unit 80 reads out the sub-scanning direction and main scanning direction correction values, which are generated in previous time for black (K) and cyan (C), from the storage unit 82.

The correction value generated in a previous time may be a value which has been stored by the 'first non-overlapping pattern adjustment processing' or which has been in S304 and S307 when the 'second non-overlapping pattern adjustment processing' has been executed in a previous time.

In below descriptions, the correction value which is stored in S304 and S307 executed in this time is referred to as a correction value generated in the present time.

In S309, for cyan (C), the control unit 80 calculates a difference between the sub-scanning direction correction value generated in a previous time and the sub-scanning direction correction value generated in this time and a difference between the main scanning direction correction value generated in previous time and the main scanning direction correction value generated in the present time.

In S310, the control unit 80 determines whether at least one of the difference between the sub-scanning direction correction values and the difference between the main scanning direction correction values is a first threshold value or larger. When a result of the determination is YES, the control unit 80 proceeds to S311. Otherwise, the control unit 80 proceeds to S318. The processing of S310 is an example of a range determination processing.

In S311, in order to acquire the positional deviation amount detected using the non-overlapping pattern 90, which is used for the calculation of the Equation 1, the control unit 80 detects positional deviation amounts in the sub-scanning direction and the main scanning direction for all the colors using the non-overlapping pattern 90.

In S312, the control unit 80 detects a positional deviation amount in the sub-scanning direction for all combinations of black (K) and other colors except cyan (C), i.e., a combination of black (K) and magenta (M) and a combination of black (K) and yellow (Y) using the sub-scanning direction overlapping pattern 100.

In S313, the control unit 80 rewrites a value, which indicates a sub-scanning direction forming position of an image formed by the image forming unit 40, based on the positional deviation amount detected in S312.

In S314, the control unit 80 generates sub-scanning direction correction values for the combination of black (K) and magenta (M) and the combination of black (K) and yellow (Y) from the positional deviation amount in the sub-scanning direction detected in S311 and the positional deviation amount in the sub-scanning direction detected in S312 and stores the generated correction values in the storage unit 82.

In S315, the control unit 80 detects a positional deviation amount in the main scanning direction for the combination of black (K) and magenta (M) and the combination of black (K) and yellow (Y) using the main scanning direction overlapping pattern 120.

In S316, the control unit 80 rewrites a value, which indicates a main scanning direction forming position of an image formed by the image forming unit 40, based on the positional deviation amount detected in S315.

In S317, the control unit 80 generates main scanning direction correction values for the combination of black (K) and magenta (M) and the combination of black (K) and yellow (Y) from the positional deviation amount in the main scanning direction detected in S311 and the positional deviation amount in the main scanning direction detected in S315 and stores the generated correction values in the storage unit 82.

In S318, the control unit 80 determines whether the sub-scanning direction correction value generated in this time is a second threshold value or larger for black (K) and cyan (C). When a result of the determination is NO, the control unit 80 proceeds to S319. Otherwise, the control unit 80 proceeds to S311. The processing of S318 is an example of a range determination processing.

In S319, the control unit 80 estimates correction values for the combination of black (K) and magenta (M) and the combination of black (K) and yellow (Y) based on the sub-scanning direction and main scanning direction correction values for black (K) and cyan (C).

In S320, the control unit stores the estimated correction values in the storage unit 82.

(7) Effects of Illustrative Embodiment

The printer 1 of the first illustrative embodiment determines whether to execute a detection processing (referred to as overlapping pattern detection processing) of a positional deviation amount using the overlapping pattern or a detection processing (referred to as non-overlapping pattern detection processing) of a positional deviation amount using the non-overlapping pattern, in accordance with the overlapping pattern execution condition and the non-overlapping pattern execution condition. Therefore, it is possible to appropriately distinguishingly use the overlapping pattern and the non-overlapping pattern by appropriately setting the execution conditions.

Also, when the high definition mode is set as the operation mode, the printer 1 executes the overlapping pattern detection processing. Therefore, it is possible to determine the positional deviation amount with high precision in the case of the high definition mode.

Also, the printer 1 executes the overlapping pattern detection processing and the non-overlapping pattern detection processing and stores the difference thereof as the correction value. Therefore, it is possible to make the positional deviation amount, which is detected using the non-overlapping pattern detection processing, be closer to the positional deviation amount detected using the overlapping pattern detection processing, so that it is possible to improve the precision of the positional deviation amount detected by the non-overlapping pattern detection processing.

Also, when the condition (b1) is satisfied, the printer 1 executes the non-overlapping pattern detection processing and the overlapping pattern detection processing for all combinations of two colors to thus generate the correction values. Therefore, for example, compared to a configuration where the non-overlapping pattern detection processing and the overlapping pattern detection processing only for a combination of the reference color and one color to generate a correction value, and correction values for other colors except the one color are estimated from the correction value for the one color, it is possible to improve the precision of the correction values for the other colors except the one color.

Also, the printer 1 executes the non-overlapping pattern detection processing and the overlapping pattern detection processing for all combinations of the reference color and each one color of the other colors to generate the correction values only when the condition (b1) is satisfied, i.e., only when a correction value is not stored in the storage unit 82. Therefore, it is possible to suppress a using amount of toner.

Also, when the conditions (b2) to (b4) are satisfied, the printer 1 does not execute the non-overlapping pattern detection processing and the overlapping pattern detection processing for the other colors except the one color and estimates the correction values therefor from the correction value for the one color. Therefore, it is possible to suppress the using amount of toner and to shorten the time necessary to form a pattern.

Also, according to the printer 1, a user can generate a correction value at a desired timing by instructing the printer 1 to generate a correction value.

Also, the printer 1 generates the correction value when the history information about the image formation satisfies the predetermined condition. Therefore, it is possible to again generate the correction value at an appropriate timing in accordance with the history information.

Also, the printer 1 first executes the non-overlapping pattern detection processing, adjusts the image forming position of the image forming unit 40 based on the positional deviation amount detected by the non-overlapping pattern detection processing, and then executes the overlapping pattern detection processing. Therefore, it is possible to improve the precision of the correction value.

Also, the printer 1 can adjust the image forming position of the image forming unit 40 based on the positional deviation amount detected by the overlapping pattern detection processing or the positional deviation amount detected by the non-overlapping pattern detection processing.

Also, according to the printer 1, the overlapping marks of the overlapping pattern have different overlapping degrees of toner images in either one of the sub-scanning direction and the main scanning direction between the marks. In the overlapping pattern detection processing, the control unit 80 detects a positional deviation amount between colors in the one direction from the phase difference between the waveform of the output signal from the optical sensor 70 and the reference waveform. Even when there is an error in a level of the output signal of the optical sensor 70, it little influences the phase difference. Therefore, when the positional deviation amount is detected by the above method, it is possible to detect the positional deviation amount with precision.

Also, the printer 1 executes the overlapping pattern detection processing (referred to as sub-scanning direction overlapping pattern detection processing) of forming the sub-scanning direction overlapping pattern 100 including the overlapping marks 101 which have different overlapping degrees of the toner images in the sub-scanning direction, on the conveyance belt 35 and detecting the positional deviation amount in the sub-scanning direction, and the overlapping pattern detection processing (referred to as main scanning direction overlapping pattern detection processing) of forming the main scanning direction overlapping pattern 120 including the overlapping marks 121 which have different overlapping degree of the toner images in the main scanning direction, on the conveyance belt 35 and detecting the positional deviation amount in the main scanning direction. After executing the sub-scanning direction overlapping pattern detection processing, the printer adjusts the sub-scanning direction forming positions of the toner images formed by the image forming unit 40, based on the positional deviation amount in the sub-scanning direction detected by the sub-scanning direction overlapping pattern detection processing and then executes the main scanning direction overlapping pattern detection processing.

When a positional deviation occurs in the sub-scanning direction, the detection precision of the positional deviation amount in the main scanning direction is lowered. However, the printer 1 adjusts the image forming position in the sub-scanning direction, based on the positional deviation amount in the sub-scanning direction, and then detects the positional deviation amount in the main scanning direction. Therefore, it is possible to suppress the detection precision of the positional deviation amount in the main scanning direction from being lowered.

Also, when the correction value generated for another one color is not within the acceptable range, the printer 1 executes the non-overlapping pattern detection processing and the overlapping pattern detection processing for the combinations of the reference color and the other colors except the one color to thus generate the correction values for the other colors except the one color.

There is a tendency that when the correction value generated for another one color is not within the acceptable range, the estimated correction values are also not within the acceptable range. When the correction is made using the correction value beyond the acceptable range, the correction precision is lowered.

However, when the correction value generated for another one color is not within the acceptable range, the printer 1 does not perform the estimation and executes the non-overlapping pattern detection processing and the overlapping pattern detection processing for the combinations of the reference color and the other colors except the one color to thus further generate the correction values. Therefore, it is possible to suppress the correction precision from being lowered.

Also, when the difference between the correction value generated in a previous time and the correction value generated in a present time is the threshold or larger, the printer 1 determines that the correction value is not within the acceptable range. When the difference between the correction value generated in the previous time and the correction value generated in the present time is the threshold or larger, there is a possibility that the humidity, the temperature, the physical states of the printer 1 and the like have been largely changed. In this case, when the estimated correction value is used, the correction precision may be lowered.

However, when the difference between the correction value generated in the previous time and the correction value generated in the present time is the threshold or larger, the printer 1 further generates the correction value. Therefore, it is possible to suppress the correction precision from being lowered.

Other Illustrative Embodiments

While the present invention has been shown and described with reference to certain illustrative embodiments thereof, it will be understood by those skilled in the art that various changes in form and details may be made therein without departing from the spirit and scope of the invention as defined by the appended claims. For example, the following illustrative embodiments also fall within the scope of the invention.

(1) In the above illustrative embodiment, the 'condition that the high definition mode is set as the operation mode of the image forming unit' has been exemplified as the overlapping pattern execution condition. However, the overlapping pattern execution condition is not limited thereto. For example, whenever the number of printed sheets after detecting the positional deviation amount reaches 100 sheets, the non-overlapping pattern detection processing may be executed and when the number of printed sheets reaches 1000 sheets, the overlapping pattern detection processing may be executed. It is possible to appropriately determine a condition with which the overlapping pattern detection processing or non-overlapping pattern detection processing is executed.

(2) In the above illustrative embodiment, the correction value is used to correct the positional deviation amount. However, the positional deviation amount may not be necessarily corrected.

(3) In the above illustrative embodiment, after the overlapping pattern detection processing using the sub-scanning direction overlapping pattern 100 is executed, the adjustment processing of adjusting the image forming position of the image forming unit in the sub-scanning direction based on the positional deviation amount in the sub-scanning direction detected by the overlapping pattern detection processing. After the adjustment processing is executed, the overlapping pattern detection processing is executed using the main scanning direction overlapping pattern 120. The sequence of executing the overlapping pattern detection processing using the sub-scanning direction overlapping pattern 100 and the overlapping pattern detection processing using the main scanning direction overlapping pattern 120 can be also applied to an image forming apparatus which detects a positional deviation only using the overlapping pattern without using the non-overlapping pattern 90. This is specifically described below.

Figure 14:
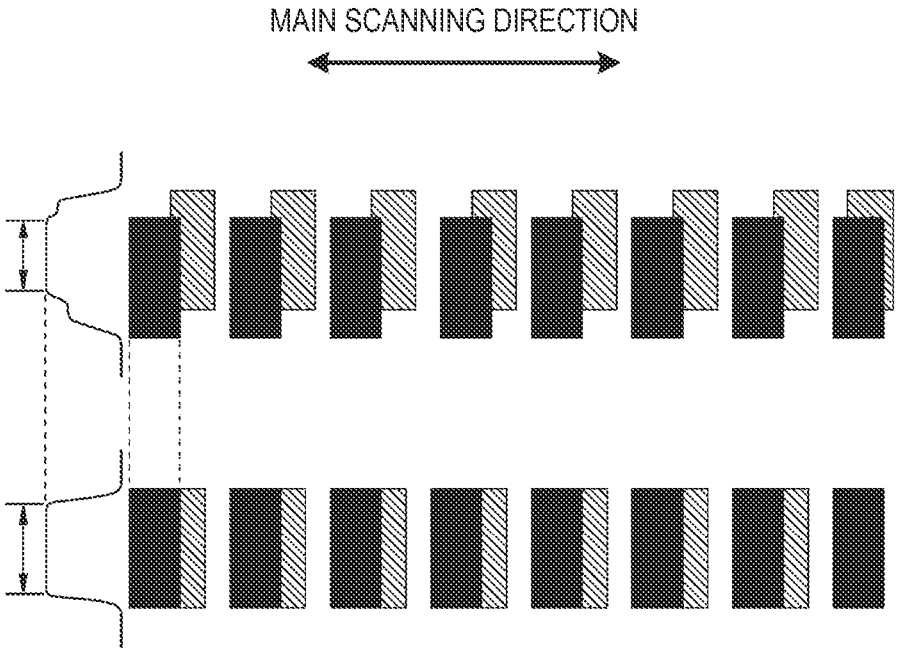
FIG. 14 is a schematic view showing a main scanning direction overlapping pattern according to another illustrative embodiment.

FIG. 14 shows a main scanning direction overlapping pattern of one line in which an overlapping mark of a first color and an overlapping mark of a second color are deviated in the sub-scanning direction. In this case, a range E in which a peak of the output signal of the optical sensor 70 continues is narrowed, compared to a case where there is no deviation in the sub-scanning direction. When the range E is narrowed, the range E may be treated as a noise. In this case, the detection precision of the positional deviation amount is lowered.

Therefore, when the overlapping pattern detection processing using the sub-scanning direction overlapping pattern 100 is first executed, the image forming position of the image forming unit in the sub-scanning direction is adjusted and then the overlapping pattern detection processing using the main scanning direction overlapping pattern 120 is executed, it is possible to reduce the positional deviation in the sub-scanning direction between the toner image of the first color and the toner image of the second color in the main scanning direction overlapping pattern 120. Thus, it is possible to suppress the detection precision of the positional deviation amount from being lowered.

(4) In the above illustrative embodiment, the direct transfer tandem-type color laser printer has been exemplified as the image forming apparatus. However, the image forming apparatus may be an intermediate transfer-type printer using an intermediate transfer belt. In this case, the intermediate transfer belt is an example of a rotation member.

(5) In the above illustrative embodiment, the control unit 80 has one CPU 80*a*. However, the control unit 80 may be configured by a plurality of CPUs, an ASIC or a combination of one or more CPUs and an ASIC.

(6) In the above illustrative embodiment, the printer has been exemplified as the image forming apparatus. However, the image forming apparatus may be a complex machine having a printer function, a scanner function, a facsimile function, a copying function and the like.

What is claimed is:

1. An image forming apparatus comprising:

an image forming device configured to form an image on a rotation member using colorant;

a sensor; and a controller configured to execute:

an overlapping pattern detection processing including:

controlling the image forming device to form an overlapping pattern in an area detectable by the sensor, wherein the overlapping pattern includes a plurality of overlapping marks arranged in a rotating direction of the rotation member, each of the overlapping marks including a colorant image of a first color and a colorant image of a second color overlapped on the colorant image of the first color, and wherein an overlapping degree of the colorant image of the first color and the colorant image of the second color is different between the overlapping marks, and detecting a positional deviation amount between the first and second colors, a non-overlapping pattern detection processing including:

controlling the image forming device to form a non-overlapping pattern in the area detectable by the sensor, wherein the non-overlapping pattern includes a plurality of marks, each of the marks having one color different from each other mark, and the marks of the non-overlapping pattern being arranged so as not to overlap with each other in the rotating direction of the rotation member, and detecting a positional deviation amount between the marks of the non-overlapping pattern; and an execution processing including:

determining whether an overlapping pattern execution condition of executing the overlapping pattern detection processing is satisfied, executing the overlapping pattern detection processing without forming the non-overlapping pattern when the overlapping pattern execution condition of executing the overlapping pattern detection processing is determined to be satisfied, determining whether a non-overlapping pattern execution condition of executing the overlapping pattern detection processing is satisfied, and executing the non-overlapping pattern detection processing without forming the overlapping pattern when the non-overlapping pattern execution condition of executing the non-overlapping pattern detection processing is determined to be satisfied.

2. The image forming apparatus according to claim 1, wherein an operation mode of the image forming device includes a high definition mode and a low definition mode in which the image forming device forms an image having a lower image quality than in the high definition mode, and wherein the overlapping pattern execution condition includes the high definition mode being set as the operation mode of the image forming device.

3. The image forming apparatus according to claim 1, further comprising:

a storage device, wherein the controller is configured to execute:

a correction value generation processing of executing the overlapping pattern detection processing and the non-overlapping pattern detection processing to generate a correction value for correcting the positional deviation amount detected by the non-overlapping pattern detection processing to be closer to the positional deviation amount detected by the overlapping pattern detection processing, wherein the correction value is generated based on the positional deviation amount detected by the overlapping pattern detection processing and the positional deviation amount detected by the non-overlapping pattern detection processing;

a storing processing of storing the correction value in the storage device; and a correction processing of correcting the positional deviation amount detected by the non-overlapping pattern detection processing with the correction value stored in the storage device.

4. The image forming apparatus according to claim 3, wherein the image forming device is configured to form an image using three or more colors, and wherein in the correction value generation processing, the controller is configured to execute the non-overlapping pattern detection processing and the overlapping pattern detection processing for all combinations of a reference color and each of other colors of the three or more colors to generate the correction value for each of the other colors.

5. The image forming apparatus according to claim 4, wherein the controller is configured to determine whether the correction value is stored in the storage device, and wherein the controller is configured to execute the correction value generation processing when the correction value is not stored in the storage device.

6. The image forming apparatus according to claim 3, wherein the image forming device is configured to form an image using three or more colors, wherein in the correction value generation processing, the controller is configured to execute the non-overlapping pattern detection processing and the overlapping pattern detection processing for a combination of a reference color and another color of the three or more colors to generate the correction value for the one color, and wherein the controller is configured to execute an estimation processing of estimating a correction value for a further color except the one color based on the correction value for the one color.

7. The image forming apparatus according to claim 6, wherein the controller is configured to execute:

a range determination processing of determining whether the correction value for the one color generated by the correction value generation processing is within an acceptable range; and when it is determined in the range determination processing that the correction value is not within the acceptable range, an additional generation processing of executing the non-overlapping pattern detection processing and the overlapping pattern detection processing for a combination of the reference color and a further color, other than the one color, to generate the correction value for the further color except the one color.

8. The image forming apparatus according to claim 7, wherein in the range determination processing, the controller is configured to determine that the correction value is not within the acceptable range when a difference between the correction value for the one color generated at a previous time and the correction value for the one color generated at a present time is a threshold value or larger.

9. The image forming apparatus according to claim 6, wherein the controller is configured to execute an instruction reception processing of receiving a generation instruction for generating the correction value, and wherein the controller is configured to execute the correction value generation processing when the generation instruction is received by the instruction reception processing.

10. The image forming apparatus according to claim 6, wherein the controller is configured to execute a storing processing of storing history information about image formation by the image forming device, in the storage device, and wherein the controller is configured to execute the correction value generation processing when the history information satisfies a predetermined condition.

11. The image forming apparatus according to claim 3, wherein in the correction value generation processing, the controller is configured to first execute the non-overlapping pattern detection processing, adjust an image forming position of the image forming device based on the positional deviation amount detected by the non-overlapping pattern detection processing, and then execute the overlapping pattern detection processing.

12. The image forming apparatus according to claim 1, wherein the controller is configured to execute an adjustment processing of adjusting an image forming position of the image forming device, based on the positional deviation amount detected by the overlapping pattern detection processing or the positional deviation amount detected by the non-overlapping pattern detection processing.

13. The image forming apparatus according claim 1, wherein the overlapping marks of the overlapping pattern have different overlapping degrees of colorant images in one of a sub-scanning direction parallel to the rotating direction of the rotation member and a main scanning direction orthogonal to the sub-scanning direction, and wherein in the overlapping pattern detection processing, the controller is configured to detect a positional deviation amount between the first and second colors in the one of the sub-scanning direction and the main scanning direction, based on a phase difference between a waveform of an output signal from the sensor and a reference waveform.

14. The image forming apparatus according to claim 1, wherein the controller is configured to execute:

a sub-scanning direction overlapping pattern detection processing of forming, on the rotation member, an overlapping pattern including a plurality of overlapping marks which have different overlapping degrees of colorant images in a sub-scanning direction, and detecting a positional deviation amount in the sub-scanning direction; and a main scanning direction overlapping pattern detection processing of forming, on the rotation member, an overlapping pattern including a plurality of overlapping marks which have different overlapping degrees of colorant images in a main scanning direction orthogonal to the sub-scanning direction, and detecting a positional deviation amount in the main scanning direction, wherein after executing the sub-scanning direction overlapping pattern detection processing, the controller is configured to execute an adjustment processing of adjusting an image forming position of the image forming device in the sub-scanning direction, based on the positional deviation amount in the sub-scanning direction detected by the sub-scanning direction overlapping pattern detection processing, and wherein after executing the adjustment processing, the controller is configured to execute the main scanning direction overlapping pattern detection processing.

15. An image forming apparatus comprising:

an image forming device configured to form an image on a rotation member using colorant;

a sensor; and a controller configured to execute:

an overlapping pattern detection processing including:

controlling the image forming device to form an overlapping pattern in an area detectable by the sensor, wherein the overlapping pattern includes a plurality of overlapping marks arranged in a rotating direction of the rotation member, each of the overlapping marks including a colorant image of a first color and a colorant image of a second color overlapped on the colorant image of the first color, and an overlapping degree of the colorant image of the first color and the colorant image of the second color is different between the overlapping marks, and detecting a positional deviation amount between the first and second colors, a non-overlapping pattern detection processing including:

controlling the image forming device to form a non-overlapping pattern in the area detectable by the sensor, wherein the non-overlapping pattern includes a plurality of marks, each of the marks having one color different from each other mark, and wherein the marks of the non-overlapping pattern are arranged so as not to overlap with each other in the rotating direction of the rotation member, and detecting a positional deviation amount between the marks of the non-overlapping pattern; and an execution processing including:

executing the overlapping pattern detection processing when an overlapping pattern execution condition of executing the overlapping pattern detection processing is satisfied, and executing the non-overlapping pattern detection processing when a non-overlapping pattern execution condition of executing the non-overlapping pattern detection processing is satisfied, wherein an operation mode of the image forming device includes a high definition mode and a low definition mode in which the image forming device forms an image having a lower image quality than in the high definition mode, and wherein the overlapping pattern execution condition is that the high definition mode is set as the operation mode of the image forming device.

16. An image forming apparatus comprising:

an image forming device configured to form an image on a rotation member using colorant;

a sensor; and a controller configured to execute:

an overlapping pattern detection processing including:

controlling the image forming device to form an overlapping pattern in an area detectable by the sensor, wherein the overlapping pattern includes a plurality of overlapping marks arranged in a rotating direction of the rotation member, each of the overlapping marks including a colorant image of a first color and a colorant image of a second color overlapped on the colorant image of the first color, and an overlapping degree of the colorant image of the first color and the colorant image of the second color is different between the overlapping marks, and detecting a positional deviation amount between the first and second colors, a non-overlapping pattern detection processing including:

controlling the image forming device to form a non-overlapping pattern in the area detectable by the sensor, wherein the non-overlapping pattern includes a plurality of marks, each of the marks having one color different from each other mark, and wherein the marks of the non-overlapping pattern are arranged so as not to overlap with each other in the rotating direction of the rotation member, and detecting a positional deviation amount between the marks of the non-overlapping pattern; and an execution processing including:

executing the overlapping pattern detection processing when an overlapping pattern execution condition of executing the overlapping pattern detection processing is satisfied, and executing the non-overlapping pattern detection processing when a non-overlapping pattern execution condition of executing the non-overlapping pattern detection processing is satisfied, wherein the controller is further configured to execute:

a sub-scanning direction overlapping pattern detection processing of forming, on the rotation member, an overlapping pattern including a plurality of overlapping marks which have different overlapping degrees of colorant images in a sub-scanning direction, and detecting a positional deviation amount in the sub-scanning direction; and a main scanning direction overlapping pattern detection processing of forming, on the rotation member, an overlapping pattern including a plurality of overlapping marks which have different overlapping degrees of colorant images in a main scanning direction orthogonal to the sub-scanning direction, and detecting a positional deviation amount in the main scanning direction, wherein after executing the sub-scanning direction overlapping pattern detection processing, the controller is configured to execute an adjustment processing of adjusting an image forming position of the image forming device in the sub-scanning direction, based on the positional deviation amount in the sub-scanning direction detected by the sub-scanning direction overlapping pattern detection processing, and wherein after executing the adjustment processing, the controller is configured to execute the main scanning direction overlapping pattern detection processing.

* * * * *